US006479950B2

(12) United States Patent
Takahashi et al.

(10) Patent No.: US 6,479,950 B2
(45) Date of Patent: Nov. 12, 2002

(54) HIGH INTENSITY DISCHARGE LAMP, DRIVING APPARATUS FOR HIGH INTENSITY DISCHARGE LAMP, AND HIGH INTENSITY DISCHARGE LAMP SYSTEM

(75) Inventors: Kiyoshi Takahashi, Hirakata (JP); Makoto Horiuchi, Sakurai (JP); Yuriko Kaneko, Nara (JP); Hideaki Kiryu, Takatsuki (JP); Mamoru Takeda, Sorkugun (JP); Takayuki Murase, Takatsuki (JP); Ryo Minamihata, Amagasaki (JP)

(73) Assignee: Matsushita Electric Industrial Co., Ltd. (JP)

( * ) Notice: Subject to any disclaimer, the term of this patent is extended or adjusted under 35 U.S.C. 154(b) by 41 days.

(21) Appl. No.: 09/739,974

(22) Filed: Dec. 20, 2000

(65) Prior Publication Data

US 2001/0005116 A1 Jun. 28, 2001

(30) Foreign Application Priority Data

Dec. 22, 1999 (JP) ..... 11-364628
Jun. 6, 2000 (JP) ..... 2000-169682
Jul. 17, 2000 (JP) ..... 2000-216514

(51) Int. Cl.[7] ..... H05B 41/36
(52) U.S. Cl. ..... 315/291; 315/56; 315/307
(58) Field of Search ..... 315/56, 246, 291, 315/307, 326, 344; 313/113

(56) References Cited

U.S. PATENT DOCUMENTS 3,988,626 A * 10/1976 Boudouris ..... 313/113
5,864,210 A * 1/1999 Hochi et al. ..... 313/641
6,043,614 A * 3/2000 Tessnow et al. ..... 315/291
6,175,199 B1 * 1/2001 Moskowitz ..... 315/291

FOREIGN PATENT DOCUMENTS

| | | | |
|---|---|---|---|
| EP | 0 324 651 | 7/1989 | ..... H05B/31/26 |
| EP | 0 342 652 | 7/1989 | ..... H01J/61/00 |
| EP | 0 502 273 | 9/1992 | ..... H01J/61/82 |
| EP | 0 626 799 | 11/1994 | ..... H05B/41/29 |
| EP | 0 942 454 | 9/1999 | ..... H01J/61/10 |
| JP | 55086062 | 6/1980 | ..... H01J/61/50 |
| JP | 59194342 | 11/1984 | ..... H01J/61/30 |
| JP | 60119070 | 6/1985 | ..... H01J/61/50 |
| JP | 62131464 | 6/1987 | ..... H01J/61/50 |
| JP | 09161725 | 6/1997 | ..... H01J/61/50 |
| JP | 09283086 | 10/1997 | ..... H01J/61/50 |
| JP | 09283087 | 10/1997 | ..... H01J/61/50 |

* cited by examiner

*Primary Examiner*—Don Wong
*Assistant Examiner*—Jimmy T. Vu
(74) *Attorney, Agent, or Firm*—Parkhurst & Wendel, L.L.P.

(57) ABSTRACT

In a high intensity discharge lamp, at least one of an arc bend amount and an apparent width of arc is controlled by a simple configuration at low cost. A high intensity discharge lamp system 110 has a high intensity discharge lamp 111 and an operating circuit 113 for driving the high intensity discharge lamp 111. In the high intensity discharge lamp 111, a rare gas and a filling material 136 containing a metal halide as a light generating substance are enclosed in the arc tube 121 provided with a pair of electrodes 122a and 122b. The lamp system is disposed such that the line connecting the electrodes 122a and 122b is horizontal, and by applying a magnetic field having a vertical magnetic flux thereto and by varying the frequency of alternating current for driving the high intensity discharge lamp 111, at least one of an arc bend amount and an apparent width of arc can be easily controlled.

26 Claims, 21 Drawing Sheets

HIGH INTENSITY DISCHARGE LAMP, DRIVING APPARATUS FOR HIGH INTENSITY DISCHARGE LAMP, AND HIGH INTENSITY DISCHARGE LAMP SYSTEM

BACKGROUND OF THE INVENTION (1) Field of the Invention

The present invention relates to a high intensity discharge lamp for use in such apparatuses as general illumination apparatuses and vehicle headlamps that use the lamp mounted to a reflector, a driving apparatus for a high intensity discharge lamp, and a high intensity discharge lamp system employing the lamp and the driving apparatus.

(2) Description of the Related Art

In recent years, high intensity discharge lamps have been employed for projectors and vehicle headlamps in which the lamps are mounted to reflectors. Such discharge lamps exhibit high efficiency, low power consumption, and high intensity in comparison with halogen lamps, and therefore are expected to receive more widespread commercial acceptance.

When a conventional high intensity discharge lamp is positioned in such a manner that the line connecting the pair of electrodes becomes horizontal, and operated by applying voltage across the pair of electrodes, (the operation in this manner is hereinafter referred to as "horizontal operation" or "horizontally operated"), the arc is bent upwards. As a result, the temperature of the upper portion of the arc tube locally becomes high, which causes such problems that devitrification of the upper portion of the arc tube or deformation of the arc tube begins at a relatively early stage in lamp life and thus the lamp life reduces.

In view of the problems, much research has been carried out to develop the technique for suppressing the arc bend and thereby improving lamp life. For example, Japanese Unpublished Patent Publication Nos. 55-86062 and 9-161725 disclose a technique for suppressing the arc bend by applying a magnetic field to a metal halide lamp.

The technique disclosed in Japanese Unpublished Patent Publication No. 55-86062 is such that by providing a strong rare earth magnet above the arc tube to apply a magnetic field to the arc tube from the upper direction thereof, the arc is forced downwards by the repulsion force between the magnet and the arc so that the upward arc bend is suppressed.

Recently, as environmental concerns have increasingly been regarded as important, it has been required that mercury not be used for general high intensity discharge lamps. However, the lamps disclosed in the above publications employ mercury as a filling material to be enclosed in the arc tube. Therefore, in order to meet such requirements as described above, it is necessary that the arc bend be suppressed in the high intensity discharge lamp in which mercury is not employed to improve the lamp life.

In addition, the high intensity discharge lamp requires a dedicated operating circuit, which incurs higher cost. Unlike a halogen lamp having two filaments, it is difficult for the high intensity discharge lamp to attain both high beam and low beam with only one lamp. For this reason, in a vehicle headlamp system, normally, two high intensity discharge lamps are used for low beam lamps in which the frequency of use is high, and two halogen lamps are used for high beam lamps. Thus, this configuration also requires four sets of mechanism for adjusting the reflector and the light axis, which also incurs high manufacturing cost and limits the freedom in the vehicle designing.

In view of this problem, there is a need for a technique by which high beam and low beam can be selected with the use of only one high intensity discharge lamp. A typical example of such a technique is, for example, described in Japanese Unexamined Patent Publication No. 11-312495, in which by using an electromagnet, the arc bend amount is varied to move the position of the light source. This technique is such that, in a discharge lamp disposed in a reflector such that the axis line of the discharge electrodes is in a horizontal direction (a horizontally operated lamp), a magnetic field transverse to the axis line is applied to the arc by an electromagnet. By applying a magnetic field in such a manner, the arc can be deflected (bent) in a downward direction by the effect of Lorentz force. In addition, by controlling the electric power supplied to the electromagnet, the Lorentz force can be varied such that selecting of low beam and high beam is possible.

However, according to a technique of controlling arc deflection by an electromagnet such as described above, an additional circuit for controlling the electric power supplied to the electromagnet is necessary, which incurs complicated device configurations and the increase in manufacturing cost. It might be possible to control the arc deflection by varying a lamp current or a discharge electrode gap, rather than varying the electric power supplied to the electromagnet, but in practice, it would be very difficult to control variations in such factors.

In addition, the present inventors found in the course of various experiments to accomplish the invention that when a magnetic field is applied to a discharge lamp, variation of luminance, flickering, occurs at times. This flickering can be classified into two kinds: the flickering that occurs at the start of the light beam immediately after the start of the lamp and the flickering that occurs during the stable operation

SUMMARY OF THE INVENTION

The present invention has been accomplished in view of the foregoing and other problems in prior art. Accordingly, it is an object of the present invention to provide a mercury-free high intensity discharge lamp in which mercury is not contained inside the arc tube, and arc bend is suppressed and long lamp life can be obtained.

It is another object of the invention to provide, with a simple and low cost configuration, a high intensity discharge lamp in which at least one of an arc bend amount and an apparent arc width can be controlled.

It is further another object of the invention to provide a driving apparatus for the high intensity discharge lamp.

It is still another object of the invention to provide a high intensity discharge lamp system employing the high intensity discharge lamp and the high intensity discharge lamp system.

It is to be understood that the aspects of the present invention to be detailed hereinafter are accomplished on the basis of an identical technical idea. Nonetheless, each of the aspects is embodied by a different embodiment or an example, and accordingly, the invention is divided into two groups, Embodiment I and Embodiment II, in which more closely related aspects are grouped. Hereinafter, the details are discussed according to each embodiment.

Summary of Embodiment I

In the process of the research and development of a high intensity discharge lamp that does not use mercury, the present inventors found that the high intensity discharge lamp in which mercury is enclosed in the arc tube exhibits a larger degree of arc bend than a discharge lamp in which mercury is enclosed in the arc tube.

When the present inventors performed the experiment in which a magnetic field is applied to the high intensity discharge lamp having a large degree of arc bend to suppress the arc bend, the present inventors surprisingly found that the magnetic flux required to eliminate the arc bend is smaller in the lamp in which mercury is not enclosed than in the lamp in which mercury is enclosed, that is, the lamp in which mercury is not enclosed does not require a strong magnetic field. The present inventors considered that the principle of suppressing the arc bend in the high intensity discharge lamp in which mercury is not enclosed may differ from that in the lamp in which mercury is enclosed.

This phenomenon was discovered from the study of the degree of the arc bend in which a magnetic field is applied to each of the lamp in which mercury is not enclosed in the arc tube and the lamp in which mercury is enclosed in the course of the research and development. By the discovery of such a phenomenon, a mercury-free high intensity discharge lamp of the invention, which utilizes a low-cost and practical technique to suppress the arc bend and thereby to improve lamp life, has been accomplished.

Thus, the foregoing and other objects are accomplished, in accordance with a first aspect of the invention, by the provision of a mercury-free high intensity discharge lamp comprising:

an arc tube;

a pair of electrodes provided in the arc tube so as to be opposed to each other; and means for generating a magnetic field having a magnetic flux component along a direction perpendicular to a line connecting a tip of one of the electrodes to a tip of the other electrode.

Further, in accordance with a second aspect of the invention, there is provided a high intensity discharge lamp as set forth in the first aspect of the invention, further comprising:

means for generating alternating current to be applied across the pair of electrodes; and wherein the lamp is operated with the alternating current supplied from the means for generating alternating current.

By employing these configurations, in the case of the high intensity discharge lamp in which mercury is not enclosed in the arc tube, the arc bend can be suppressed by the means for generating a magnetic field by applying a magnetic field smaller than in the case of the lamp in which mercury is enclosed in the arc tube, and thereby the improvement in lamp life of a high intensity discharge lamp can be achieved in a low-cost and practical manner. In addition, by employing the alternating current operation, the arc bend caused by the Lorentz force acting on the arc in one direction can be prevented.

In accordance with a third aspect of the invention, there is provided a high intensity discharge lamp as set forth in the first aspect of the invention, wherein the lamp is disposed such that the line connecting the tips of the electrodes is horizontal, and the means for generating a magnetic field applies a magnetic field in a vertical direction.

When the lamp is disposed such that the line connecting the tips of the electrodes is horizontal as described above, an arc bent upwards tends to be formed, and therefore by applying the magnetic field in a vertical direction with the means for generating a magnetic field during the operation, the suppressing of the arc bend can be easily attained.

In accordance with a fourth aspect of the invention, there is provided a high intensity discharge lamp as set forth in the first aspect of the invention, wherein the means for generating a magnetic field is a permanent magnet.

When the high intensity discharge lamp is configured such that a constant magnetic field is applied with a permanent magnet, the suppressing of the arc bend and the longer lamp life can be achieved at low cost.

In accordance with a fifth aspect of the invention, there is provided a high intensity discharge lamp as set forth in the first aspect of the invention, wherein a metal halide is enclosed in the arc tube, and a vapor pressure of the metal halide at a temperature of 900° C. is 0.1 MPa or higher. In accordance with a sixth aspect of the invention, the metal halide of the six aspect of the invention may include indium halide. The metal halide may include InI or $InI_3$.

By employing such a configuration in which a metal halide is enclosed in the arc tube, the density of the metal halide is increased in the arc tube and thereby the arc becomes thinner, which reduces the width of the arc generated between the pair of the electrodes. When the width of the arc is reduced, the arc tends to become more susceptible to the convection current in the arc tube, resulting in a larger arc bend. By applying a magnetic field to such an arc having a large bend, applying a magnetic field becomes more effective. As the metal halide, halides of indium are preferable, and InI or $InI_3$ is more preferable since they cause a higher luminous efficacy.

In accordance with a seventh aspect of the invention, there is provided a high intensity discharge lamp as set forth in the first aspect of the invention, wherein the means for generating a magnetic field is a film composed of a magnetic material formed either on a surface of the arc tube or on an outer tube provided outside the arc tube. In accordance with an eighth aspect of the invention, the means for generating a magnetic field may be supported by a supporting means. In accordance with a ninth aspect of the invention, the supporting means is a wiring member having an electrical continuity with one of the electrodes or a supporting member supporting the wiring member.

By employing these configurations, the arc bend is suppressed and thereby the lamp life of the high intensity discharge lamp can be improved.

Summary of Embodiment II

In the course of various attempts at improving the lamp life of a high intensity discharge lamp by suppressing the arc bend, the present inventors also discovered, surprisingly, that by varying the operating frequency of the lamp current while a magnetic field is applied to the lamp, the arc bend amount, i.e., the position of the arc can be varied even at a constant magnetic intensity.

Generally, when a lamp is operated with alternating current at a predetermined frequency without applying a magnetic field, the arc is bent by the effect of the convection current inside the arc tube. When a magnetic field having a magnetic flux along the same direction of the arc bend is applied, a force that suppresses the arc bend acts on the arc, reducing the arc bend amount. When the frequency of the alternating current is further increased, the force caused by the magnetic field, which suppresses the arc bend, acts on the arc exceedingly, conversely increasing the arc bend amount. In this phenomenon, the direction of the change in the arc bend amount is the same direction as that of the magnetic flux, which indicates this phenomenon is caused by a different principle from that of the phenomenon in which, by the effect of Lorentz force, the arc bend amount changes in a direction perpendicular to the direction of the magnetic flux.

The term "the arc bend amount" herein is defined to be, as shown in FIG. 14, a distance from the axis P of the electrodes 122*a* and 122*b* to the center 192 of the arc 191 when a high intensity discharge lamp is horizontally operated with, for example, a rectangular wave alternating current.

Further, the present inventors also discovered that by varying the operating frequency while a magnetic field is applied in the same direction as that of the arc bend, an apparent arc width can be varied. This phenomenon occurs because the arc receives a Lorentz force in a direction perpendicular to the arc bend, and the arc bend is shifted in the direction of the Lorentz force. When a discharge lamp is operated with alternating current, at the same time as the current polarity reversal, the direction of the Lorentz force changes into the opposite direction to the direction in which the Lorentz force has acted before the polarity reversal, and the arc is shifted in the reversed direction. Therefore, since the cycle of the electric current flowing in one direction can be varied by varying the frequency, the time in which the Lorentz force acts in one direction can be varied accordingly. For example, when the operating frequency becomes lower, the time during which the Lorentz force acts on the arc in one direction increases and the migration distance of the arc in the horizontal plane accordingly increases, making the observer perceive that the apparent arc width in the horizontal plane has increased.

The term "apparent arc width" herein is defined as follows. As shown in FIG. 14, a high intensity discharge lamp is horizontally operated with, for example, a rectangular wave alternating current, and, while the arc is being viewed from the top, the distance between two points 101*a* and 101*b* positioned on the line X perpendicular the line connecting the electrodes 122*a* and 122*b* at each of which points the luminance is 20% of the maximum luminance, is obtained. The distance thus obtained is defined to be the apparent arc width herein.

By the discovery of the above-described phenomenon, an aspect of the present invention has been accomplished in which at least one of an arc bend amount and an apparent arc width can be easily controlled.

In accordance with a tenth aspect of the invention, there is provided a driving apparatus for driving a high intensity discharge lamp comprising an arc tube, a pair of electrodes, means for generating a magnetic field comprising a magnetic flux component along a direction perpendicular to a line connecting a tip of one of the electrodes to a tip of the other electrode, the driving apparatus comprising:

means for generating alternating current to be applied across the pair of electrodes; and a frequency controlling means for controlling the means for generating alternating current such that a frequency of the alternating current is varied.

In the case of employing the configuration above in which a constant magnetic field is applied as well, by varying the frequency of the lamp current, at least one of the arc bend amount and the apparent arc width can be controlled, which makes it possible to achieve a much more simplified configuration than in the case of employing an electromagnet and an electric power controlling circuit therefor. Furthermore, by employing a permanent magnet as a means for generating a magnetic field, a further simplified configuration can be achieved. It is noted that the term "high intensity discharge lamp" is intended to include a high intensity discharge lamp in which mercury is enclosed in the arc tube and a high intensity discharge lamp in which mercury is not enclosed in the arc tube such as described in the Summary of Embodiment I.

In accordance with an 11th aspect of the invention, there is provided a driving apparatus for a high intensity discharge lamp as set forth in the 10th aspect of the invention, wherein the frequency controlling means controls the means for generating alternating current in such a manner that the frequency of the alternating current varies with a predetermined cycle. In accordance with a 12th aspect of the invention, there is provided a high intensity discharge lamp as set forth in the 10th aspect of the invention, wherein the means for generating alternating current varies the frequency by frequency modulation, the means for generating alternating current being controlled by the frequency controlling means.

By varying the frequency, when flickering (variation in luminance) tends to occur where a magnetic field is applied to the high intensity discharge lamp, such flickering can be easily suppressed.

In accordance with a 13th aspect of the invention, there is provided a driving apparatus for a high intensity discharge lamp as set forth in the 10th aspect of the invention, wherein the frequency controlling means controls the means for generating alternating current in such a manner that the frequency of the alternating current is varied according to a lamp current.

In accordance with a 14th aspect of the invention, there is provided a driving apparatus for a high intensity discharge lamp as set forth in the 13th aspect of the invention, further comprising: means for detecting a lamp current; and wherein the frequency controlling means controls the means for generating alternating current in such a manner that, in response to an output from the means for detecting a lamp current, the frequency of the alternating current is varied according to a lamp current.

In accordance with a 15th aspect of the invention, there is provided a driving apparatus for a high intensity discharge lamp as set forth in the 13th aspect of the invention, wherein:

the means for generating alternating current generates a larger current at the start of the high intensity discharge lamp than during a stable operation of the high intensity discharge lamp;

the driving apparatus has a timer for detecting a time at which a predetermined time from a starting of the high intensity discharge lamp has elapsed; and the frequency controlling means controls the means for generating alternating current in such a manner that the frequency of the alternating current from the start of the high intensity discharge lamp until the predetermined time has elapsed is higher than that during the stable operation of the high intensity discharge lamp.

By employing such a configuration, the flickering, which especially occurs when a lamp current is large, can be easily suppressed in a reliable manner.

In accordance with a 16th aspect of the invention, there is provided a driving apparatus for a high intensity discharge lamp as set forth in the 10th aspect of the invention, wherein the means for generating alternating current generates an alternating current containing a ripple having a ripple rate of 10% or more By employing alternating current containing a ripple, it is also possible to easily suppress the flickering.

Further, in the driving apparatus for the high intensity discharge lamp described above, the alternating current generated by the means for generating alternating current may be a rectangular wave current.

Thereby, the frequency of the alternating current can be easily varied and controlling of the arc bend amount can be easily performed.

In accordance with a 17th aspect of the invention, there is provided a driving apparatus for a high intensity discharge lamp as set forth in the 10th aspect of the invention, wherein the frequency controlling means changes the frequency of the alternating current supplied from the means for generating alternating current in such a manner that at least one of an arc bend amount and an apparent arc width is controlled.

By employing such a configuration, since at least one of an arc bend amount and an apparent arc width can be controlled by the frequency controlling means, when, for example, the high intensity discharge lamp is mounted to a reflector, light distribution characteristics of a light reflected from the reflector can be altered.

In accordance with an 18th aspect of the invention, there is provided a high intensity discharge lamp system comprising:

a high intensity discharge lamp comprising an arc tube, a pair of electrodes, means for generating a magnetic field comprising a magnetic flux component along a direction perpendicular to a line connecting a tip of one of the electrodes to a tip of the other electrode; and the driving apparatus for driving a high intensity discharge lamp according to claim 10.

In accordance with a 19th aspect of the invention, there is provided a high intensity discharge lamp system as set forth in the 18th aspect of the invention, wherein the means for generating a magnetic field is a permanent magnet.

In accordance with a 20th aspect of the invention, there is provided a high intensity discharge lamp system as set forth in the 18th aspect of the invention, wherein the high intensity discharge lamp is operated such that the magnetic flux component is vertical.

In accordance with a 21st aspect of the invention, there is provided a high intensity discharge lamp system as set forth in the 18th aspect of the invention, wherein the high intensity discharge lamp is a mercury-free discharge lamp comprising in the arc tube at least a rare gas and a metal halide.

In accordance with a 22nd aspect of the invention, there is provided a high intensity discharge lamp system as set forth in the 21st aspect of the invention, wherein the metal halide comprises indium halide.

By employing the above-described configurations, by not varying the intensity of the magnetic field but varying the frequency, the arc bend amount can be easily controlled with a simple configuration, which achieves a high intensity discharge lamp system in which the configuration is further simplified with the use of a permanent magnet. In particular, when mercury is not included in the filling material in the arc tube, the controlling of the arc bend amount is further facilitated In accordance with a 23rd aspect of the invention, there is provided a high intensity discharge lamp system as set forth in the 18th aspect of the invention, further comprising:

a reflector reflecting a light emitted from the high intensity discharge lamp; and wherein the frequency controlling means varies a light distribution characteristic of the light reflected from the reflector by adjusting the frequency of the alternating current.

In accordance with a 24th aspect of the invention, there is provided a high intensity discharge lamp system as set forth in the 23rd aspect of the invention, wherein the frequency controlling means adjusts a direction of an optical axis of the light reflected from the reflector by changing the frequency of the alternating current.

In accordance with a 25th aspect of the invention, there is provided a high intensity discharge lamp system as set forth in the 23rd aspect of the invention, wherein the frequency controlling means adjusts a direction of an optical axis of the light reflected from the reflector by changing the frequency of the alternating current in such a manner that the direction of the optical axis of the reflected light is directed in at least two directions.

By employing these configurations, it is possible to construct a low-cost high intensity discharge lamp system having a simplified configuration that can be suitably used for, for example, vehicle headlamps in which the adjustment of optical axis or the selecting between high beam and low beam is required. Specifically, the configurations can eliminate a mechanism for adjusting an optical axis mechanically, and achieve a system in which only one lamp is necessary for both low beam and high beam. It is noted that, in addition to making the system capable of selecting a plurality of beams, such as high beam and low beam, the adjustment of the optical axis can be adapted to one of the beams, or all of the beams.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Now, with reference to the figures, preferred embodiments of the present invention are detailed below.

Embodiment I

Discussed in Embodiment I is a high intensity discharge lamp in which a pair of electrodes are opposed to each other in an arc tube and no mercury is enclosed in the arc tube. The lamp has a magnetic field generating means for generating a magnetic field, and the magnetic field generating means generates a magnetic field having a magnetic flux component perpendicular to a line connecting the tips of the pair of electrodes. By this lamp, arc bend can be suppressed without using a strong magnetic field, and a long lamp life can be achieved. Based on Examples I-1 and I-2, more specific details are given below.

Example I-1

Discussed in Example I-1 are desirable sizes and directions of a magnetic field to be applied to a high intensity discharge lamp so as to obtain the effect of suppressing arc bend.

Figure 1A:
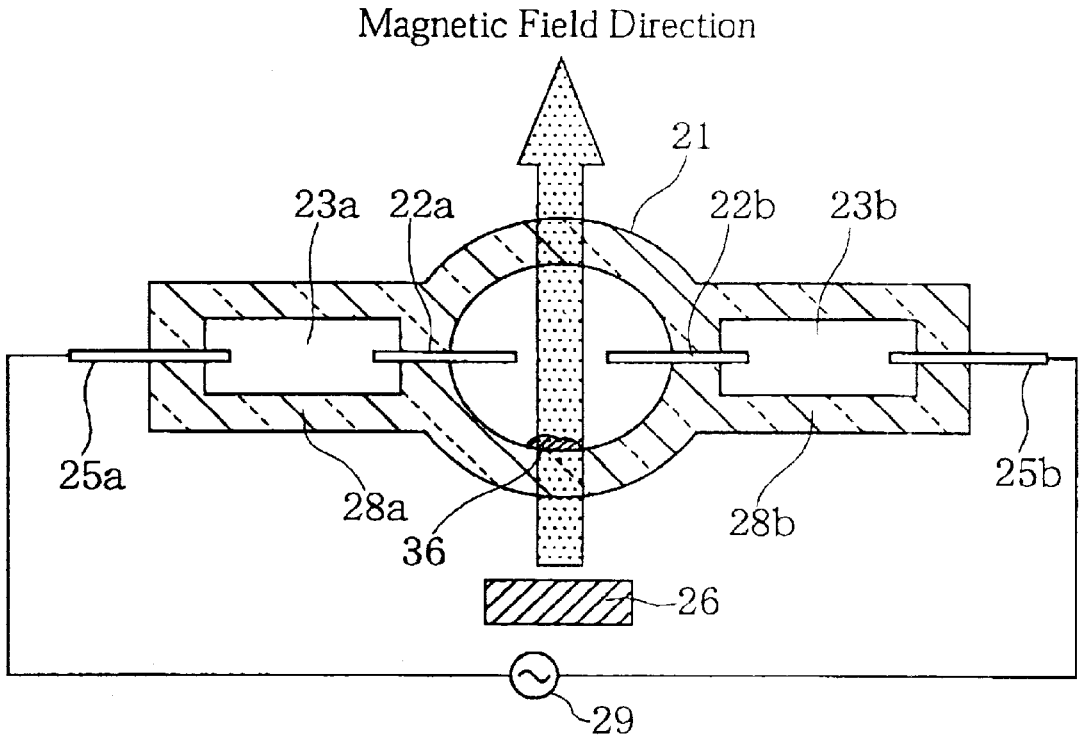
FIGS. 1(*a*) and 1(*b*) are schematic side views showing a high intensity discharge lamp of Example I-1 according to the present invention.
Figure 1B:
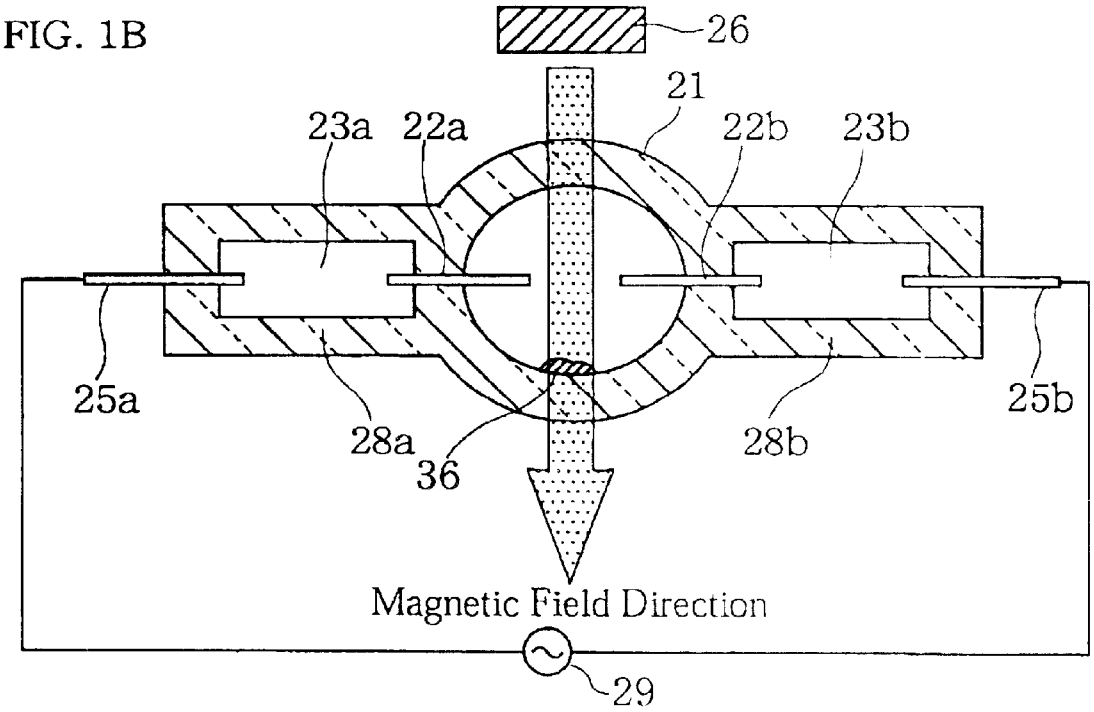

FIGS. 1(*a*) and 1(*b*) show schematic side views of a high intensity discharge lamp of Example I-1. The high intensity discharge lamp comprises an arc tube 21 made of quartz, a pair of electrodes (tungsten electrodes) 22*a* and 22*b* provided inside the arc tube 21, and a filling material 36 enclosed in the arc tube 21. The lamp is so configured that the arc tube 21 has an internal volume of approximately 0.025 cc, the distance between opposing tips of the electrodes (electrode gap) is approximately 4 mm, and a line connecting between the electrodes 22*a* and 22*b* is horizontal. Above or below the arc tube 21, a Φ10×5 mm small-sized ferrite permanent magnet 26 is provided to apply between the electrodes 22*a* and 22*b* a magnetic field including a magnetic flux component perpendicular to the foregoing line. FIG. 1(*a*) shows a case where the ferrite permanent magnet applies the magnetic field in an upward vertical direction, and FIG. 1(*b*) shows a case where the ferrite permanent magnet applies the magnetic field in a downward vertical direction.

Each of the electrodes 22*a* and 22*b* is connected to leads (molybdenum lead) 25*a* and 25*b* respectively via metal foils (molybdenum foil) 23*a* and 23*b* hermetically sealed in electrode-sealing portions 28*a* and 28*b* provided at respective sides of the arc tube 21. Each of the external leads 25*a* and 25*b* is connected to an alternating current power source 29 for supplying alternating current, and the alternating current power source 29 supplies alternating current to operate the lamp.

In the arc tube 21, a filling material 36 is enclosed and for the filling material 36, a metal halide is used. Examples of the metal halide include indium iodide ($InI_3$) having a positive valence of 3, thallium iodide (TlI), scandium iodide ($ScI_3$), and sodium iodide (NaI). Also in the arc tube 21, xenon gas, a rage gas, is enclosed at a pressure of approximately 1.4 MPa at room temperature. Note that mercury is not enclosed in the arc tube 21 of the high intensity discharge lamp.

A high intensity discharge lamp of Example 1 was prepared in accordance with the above-described configuration. In addition, as an example of a prior art high intensity discharge lamp, there was prepared a high intensity discharge lamp having the same configuration as the above-described lamp of the present example shown in FIG. 1 except that mercury, $ScI_3$, and NaI were contained in the filling material 36 shown in FIG. 1. In other words, the high intensity discharge lamp of the present example and the prior art high intensity discharge lamp differed in whether mercury is enclosed in the arc tube or not.

These high intensity discharge lamps were horizontally operated with a 400 Hz rectangular wave, and the arc bend of each lamp was observed while varying the size and direction of the magnetic field affecting the arc by adjusting the position of the ferrite permanent magnet 26 within a plane intersecting the center of the line connecting the pair of electrodes and perpendicular to the line connecting the pair of electrodes.

Table 1 below shows the required sizes of magnetic fields to be applied to the arc to suppress the arc bend, and the positions of the ferrite permanent magnet.

In Table 1, "Above Lamp" means that the ferrite permanent magnet 26 is disposed above the lamp as shown in FIG. 1(*b*). This causes the application of magnetic field in the direction perpendicular to the arc. Likewise, "Below Lamp" means that the ferrite permanent magnet 26 is disposed below the lamp as shown in FIG. 1(*a*) This also causes the application of magnetic field in the direction perpendicular to the arc.

TABLE 1

(Unit: T)

| Type of Lamp | Position of magnet | |
|---|---|---|
| | Above lamp | Below lamp |
| High intensity discharge lamp of the invention | 0.01 | 0.01 |
| Prior art high intensity discharge lamp | 0.05 | Unable to suppress the bend |

As shown in Table 1, with the prior art high intensity discharge lamp (in which mercury is enclosed in the arc tube), when the magnet was disposed above the lamp, the effect of suppressing arc bend was not obtained. However, when the magnet is disposed below the lamp, the arc bend was conversely increased and the effect of suppressing arc bend was not obtained. By contrast, with the high intensity discharge lamp of the present example (in which mercury is not enclosed in the arc tube), it was surprisingly found that the effect of suppressing arc bend was obtained both in the cases of disposing the magnet above and below the lamp.

While the cause of such a phenomenon was not clear, the present inventors assumed that the principle of suppressing the arc bend in a high intensity discharge lamp in which mercury is enclosed is different from that of suppressing the arc bend in a high intensity discharge lamp in which mercury is not enclosed. For both of the lamps, the magnetic polarity of the magnet was varied but the effects were the same, which indicates that the effects have no dependency on the magnetic polarity.

In addition, the magnetic flux density required to eliminate the arc bend in each lamp was compared. In the prior art high intensity discharge lamp, the required magnetic flux density was approximately 0.05 T, whereas in the high intensity discharge lamp of the present example, the required magnetic density was approximately 0.01 T, which was a remarkable improvement over the prior art lamp.

In other words, it was found that the high intensity discharge lamp of the present example can achieve the effect of suppressing arc bend at ⅕th of the magnetic flux density compared with the prior art lamp. The prior art high intensity discharge lamp requires a relatively large magnetic flux density of 0.05 T to eliminate the arc bend, and thus necessitates a rare-earth magnet having a large magnetic flux density.

By contrast, the high intensity discharge lamp of the present example can suppress the arc bend with a smaller magnetic field than that required by the prior art lamp, and therefore can employ a relatively low-cost ferrite permanent magnet to realize the effect. In summary, the high intensity discharge lamp of the present example shows a method by which the arc bend can be suppressed in a practical manner at low cost, and as a result, achieves a longer lamp life. Note that this effect is only applicable to high intensity discharge lamps that do not include mercury in the filling material.

Although a ferrite permanent magnet is employed in the present example, this is to be considered illustrative and not limiting, and a rare-earth magnet may be employed which has a large magnetic flux density and a small size. In the present example, the ferrite permanent magnet 26 was placed with a distance of approximately 10 mm away from the arc tube 21 to control the arc bend as shown in Table 1 above.

Figure 2:
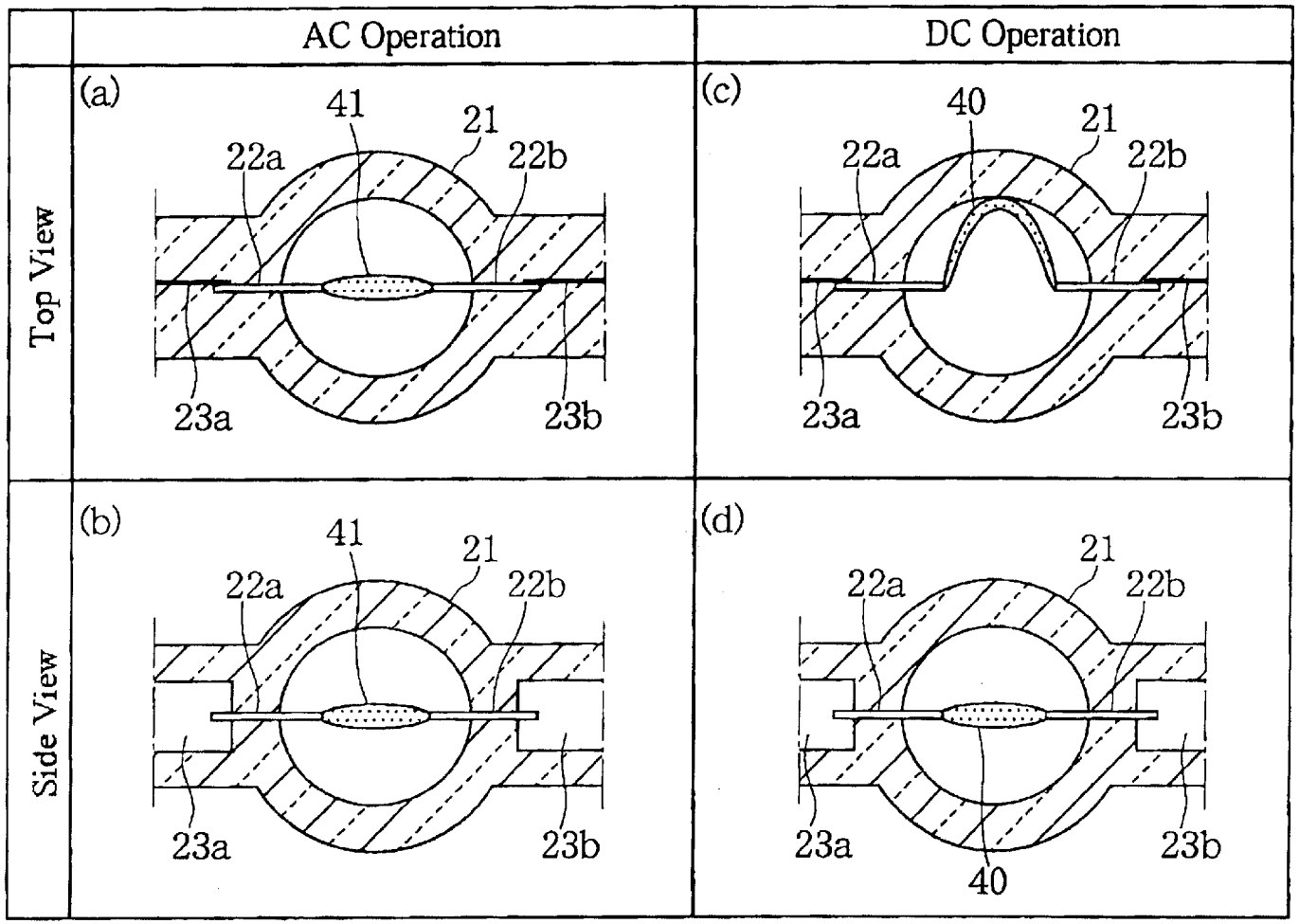
FIGS. 2(*a*) to 2(*d*) are schematic cross-sectional views illustrating the states of arc bend in the case where the high intensity discharge lamp is operated with direct current and in the case with alternating current.

The present example employs an alternating current operation to operate the high intensity discharge lamp. The reason is now discussed with reference to FIG. 2. FIG. 2 schematically illustrates the states of arc bend in the case of operating the lamp with alternating current and in the case of operating the lamp with direct current. It is to be noted that while not shown in FIG. 2 for clarity, a magnetic field having a magnetic flux component perpendicular to the line connecting the tips of the pair of electrodes 22*a* and 22*b* is applied to the arc by a ferrite permanent magnet.

When the high intensity discharge lamp is DC operated and in the state where the magnetic field is applied to the arc, an arc 40 curves in a horizontal direction to such a degree as to make a contact with the wall of the arc tube as shown in the schematic top view (viewed from the direction in which the magnetic field is applied) FIG. 2(*c*), but as shown in the schematic side view FIG. 2(*d*), the arc 40 does not curve in the upper direction of the figure. This phenomenon occurs because a Lorentz force is applied to the arc 40 in a horizontal direction and thereby the curve of the arc moves in the direction of the Lorentz force.

By contrast, when the high intensity discharge lamp is AC operated and in the state where the magnetic field is applied to the arc, the arc maintains the stable condition not being bent in either horizontal or vertical directions as shown in FIGS. 2(*a*) and (*b*). The reason is considered to be as follows. Due to the polarity reversal of the electric current, the Lorentz force works in both horizontal directions so that the forces in two directions compensate each other. Thereby, the arc bend is suppressed.

Figure 3:
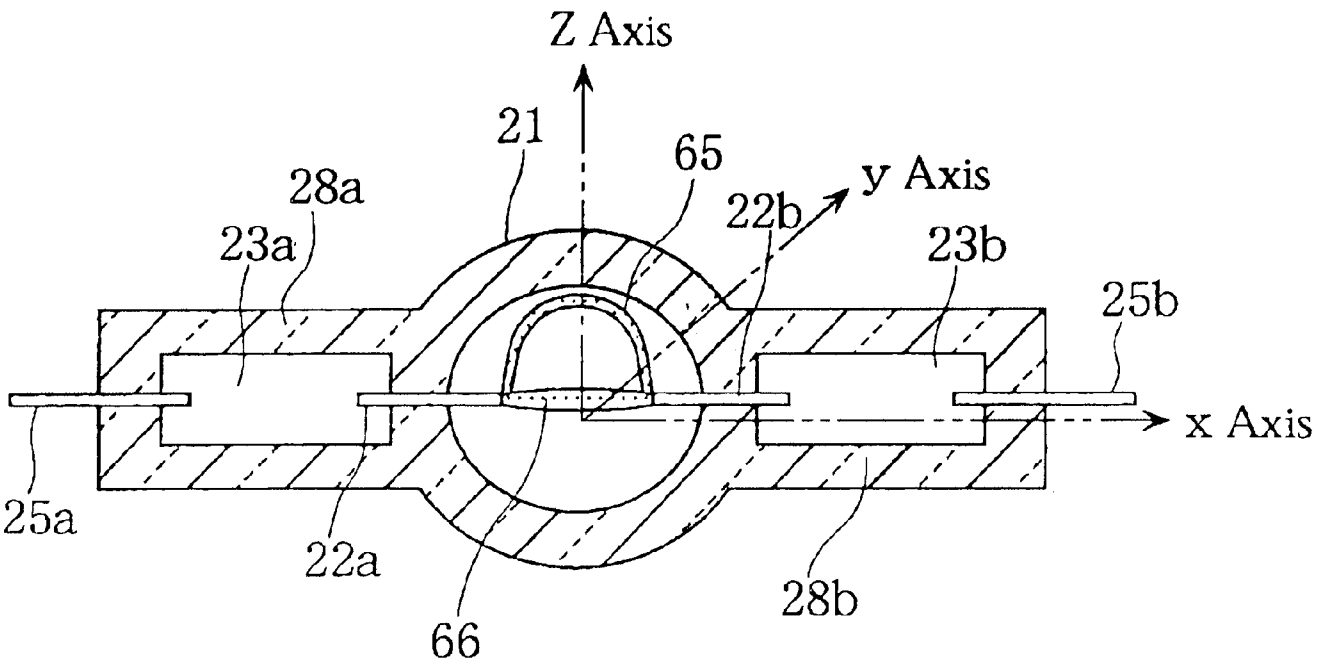
FIG. 3 is a schematic view for illustrating the arc bend.

Accordingly, by operating the high intensity discharge lamp with alternating current, it is made possible to avoid the instance in which the arc makes contact with the arc tube wall, which results in a longer lamp life. More specifically, as shown in FIG. 3, where the axis connecting the tips of the electrodes 21A–21B is the x-axis, the direction in which the magnetic field is applied is the z-axis, and the axis perpendicular to both the x-axis and the z-axis is y-axis, when the magnetic field is not applied to the high intensity discharge lamp, the arc is susceptible to the effect of the convection inside the arc tube 21 and is bent in the direction of the z-axis as shown by the reference numeral 65. However, when the magnetic field parallel to the z-axis is applied to the arc, the arc bend is suppressed according to the size of the magnetic flux density of the magnetic field applied to the arc, as shown by the reference numeral 66.

It is to be noted that the same effect may be achieved by operating the lamp with direct current and by applying alternating current to a coil so as to apply alternating magnetic field to the arc.

It is to be noted that the magnetic flux densities shown in the present example are illustrative and not limited to the values mentioned above, since the required magnetic flux density varies depending on the conditions of a lamp.

The present inventors confirmed that similar effects were obtained as long as the lamp does not have mercury in the arc tube. Therefore, it is to be understood that the filling material is not limited to the material as described in the present example.

Using a lamp in which $ScI_3$ and NaI are enclosed in the arc tube as the filling material (hereafter referred to as "comparative lamp") and the lamp of Example I-1, the arc bend amount in each lamp was measured. The method of the measurement will be detailed in Example II-1 below.

As shown in Table 2 below, while the arc bend amount of the comparative lamp was 7 (relative value), that of the high intensity discharge lamp of Example I-1 was 23 (relative value).

TABLE 2

| | Arc bend amount (Relative value) |
|---|---|
| Lamp of Example I-1 | 23 |
| Comparative Lamp | 7 |

By selecting metal halides having a high vapor pressure such as $InI_3$ and TlI, the density of the metal halides is increased, which reduces the width of the arc generated between the pair of the electrodes. When the width of the arc is reduced, the arc tends to become more susceptible to the convection current in the arc tube, resulting in a larger arc bend. Among halogens, iodine exhibits such an effect to a greater degree. Thus, since a lamp in which a metal halide of iodide is enclosed in the arc tube shows a large arc bend, the effect of applying a magnetic field to the are to suppress the arc bend is more conspicuous in such a lamp.

The vapor pressure of a metal halide employed in a general lamp is determined by the temperature at the coldest point, which is approximately 900° C. Also, when the vapor pressure of the metal halide exceeds 0.1 MPa, the above-described tendency becomes conspicuous. Examples of metal halides having a vapor pressure of 0.1 MPa at 900° C. include $HfBr_4$, $HfI_4$, $ZrI_4$, $TeI_4$, $GaBr_3$, $GaI_3$, $TiBr_4$, $TiI_4$, $SbBr_3$, $SbI_3$, $AlBr_3$, $AlI_3$, $AsI_3$, InI, $InI_3$, InBr, $BiI_3$, $SnCl_2$, $SnBr_2$, $SnI_4$, $SnI_2$, $NiI_2$, $MgI_2$, $ZnI_2$, TlCl, TlBr, TlI, $PbBr_2$, $PbI_2$, $FeI_2$. By enclosing a substance selected from these, the density of metal halide is increased and thereby the arc bend (bend) becomes larger. Therefore, the effect of applying a magnetic field to suppress the arc bend is also larger.

Among the metal halide listed above, lamp voltage can be conspicuously increased by a halide of indium, preferably InI, more preferably $InI_3$. Therefore, with these metal halides, the lamp operation can be performed with a smaller current, which makes it possible to reduce the size of the operating circuit. Further, these metal halides increase luminous efficacy and therefore are more useful.

In the present example, a ferrite permanent magnet is employed as an example of a means to apply a magnetic field to the arc. However, although the ferrite permanent magnet is low in cost and widely-used, the magnetic force greatly decreases with temperature increase, which makes it difficult to use the magnet in a position close to the lamp. Accordingly, it is preferable to dispose the magnet in a place where the influence of the heat from the lamp is not great.

However, when an alnico magnet is employed as a means to apply a magnetic field to the arc, the magnet can be placed in a position close to the lamp since the alnico magnet does not suffer from such a large decrease in the magnetic force caused by heat. Therefore, when an alnico magnet is employed, a small sized magnet can be used in comparison with the ferrite permanent magnet. As can be understood from this, the magnet may be suitably selected depending upon the conditions and purposes of the use.

Example I-2

Now, Example I-2 of the present invention is discussed below. In the present example, there are shown several embodiments of the desirable positions of the magnetic field generating means to apply a magnetic field to a lamp.

Figure 4:
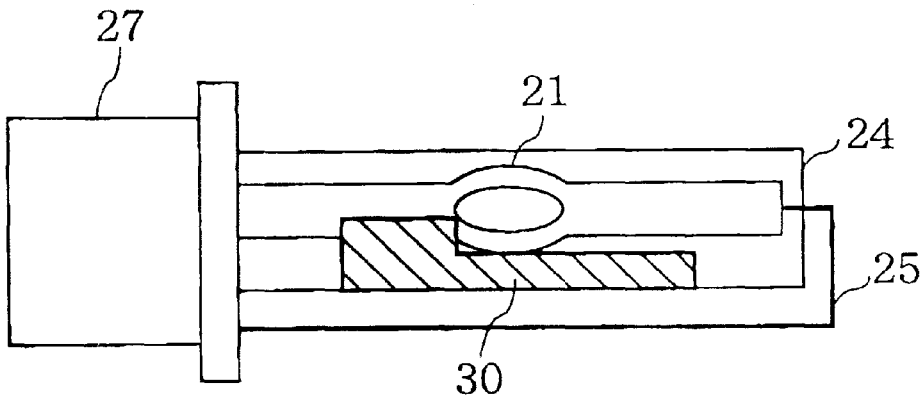
FIG. 4 is a schematic side view showing a high intensity discharge lamp of Example I-2 according to the present invention.

FIG. 3 shows a schematic side view of a high intensity discharge lamp of Example I-2 according to the present invention. In FIG. 4, the reference numeral 21 denotes the arc tube described in Example I-1 above, and the detailed configuration of the lamp is identical to that of the high intensity discharge lamp shown in FIG. 1, except that the permanent magnet in FIG. 1 is not provided. The arc tube 21 is enclosed in an outer tube 24 made of transparent glass, and the outer tube 24 is fixed to a base 27. In the arc tube 21, a pair of electrodes (not shown) are provided and each of the pair of electrodes is connected to a lead (molybdenum lead) 25 via a metal foil (not shown). The reference numeral 30 denotes a magnetic material film coated on the outer tube 24. The magnetic material film 30 has a light transmissive characteristic since the film is composed of a magnetic film having a light transmissivity or made to have an appropriately controlled film thickness.

The lamp of the present example is horizontally operated with rectangular wave alternating current, and so configured that the magnetic material 30 provided below the lamp applies a magnetic filed for suppressing arc bend to the arc. Thus, the lamp can achieve the effect of suppressing arc bend in the same manner as the lamp shown in Example I-1 above.

By making the magnetic material film 30 have a light blocking characteristic, the magnetic material film 30 can have both functions of blocking light and supplying a magnetic field. When this configuration is employed, in the case where the lamp is mounted to a reflector and used for a vehicle headlight, the magnetic material film can block the light proceeding towards the reflector (see FIG. 7) and prevent the light from being reflected by the reflector and thereby proceeding upwards, and consequently, it is possible to prevent the light proceeding towards oncoming cars. Furthermore, the manufacturing step of providing a magnet can be eliminated, and still further, since a shadow caused by the magnet is eliminated, the adverse effects on light distribution characteristics of the lamp caused by the shadow can be eliminated. Specifically, for the magnetic material film 30, a light blocking film containing a magnetic material can be used.

Figure 5:
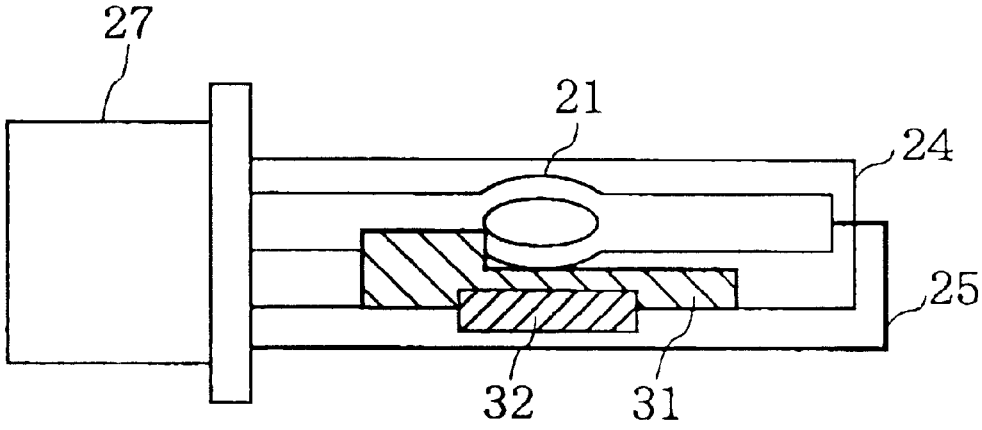
FIG. 5 is a schematic side view showing another embodiment of the high intensity discharge lamp of Example I-2 according to the present invention.

FIG. 5 shows another embodiment of the high intensity discharge lamp according to the present example. The lamp shown in FIG. 5 has the same configuration as that of the lamp shown in FIG. 4 except that a light blocking film 31 does not contain a magnetic material, and that the ferrite permanent magnet 32 is disposed on the outer tube 24 to be provided outside the arc tube 21. The ferrite permanent magnet 32 is disposed in a portion where the shadow is formed by the blocking of the emitted light from the arc tube 21 by the light blocking film 31, and is so configured that a magnetic field for suppressing the arc bend can be applied to the arc during the operation. Thus, when being operated with rectangular wave alternating current, this lamp can also achieve the effect of suppressing the arc bend in the same manner as the lamp of Example I-1 can. In addition, since the light blocking film 31 is provided, the lamp is free from the adverse effects on the light distribution characteristics caused by the shadow cast by the ferrite permanent magnet 32.

Figure 6:
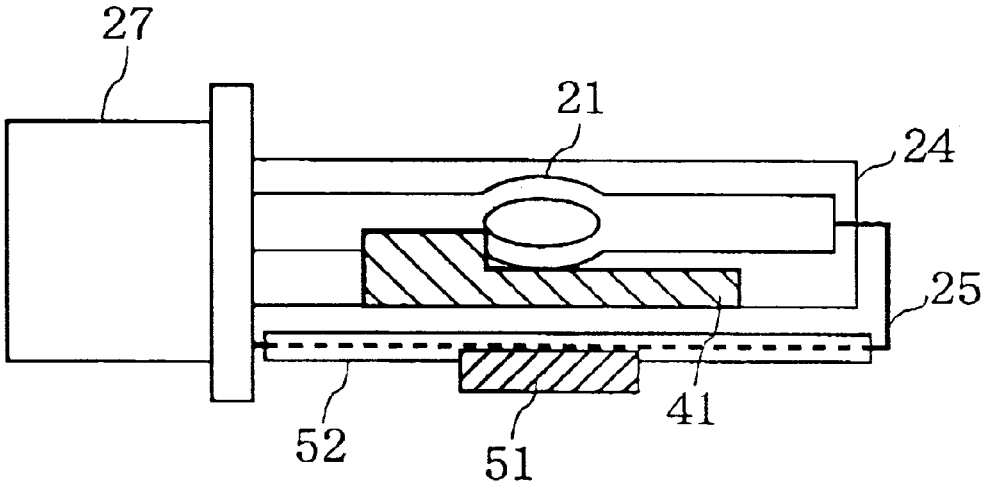
FIG. 6 is a schematic side view showing further another embodiment of the high intensity discharge lamp of Example I-2 according to the present invention.

Further, an embodiment shown in FIG. 6 is also possible. FIG. 6 shows a schematic side view of another exemplary configuration of the high intensity discharge lamp of Example I-2 according to the present invention. The lamp shown in FIG. 6 has the same configuration as the lamp of FIG. 5 except that the ferrite permanent magnet 51 is supported by a supporting means.

The supporting means may be a lead 25 for supplying electric power which is disposed near the arc tube 21 to have electrical continuity with one of the pair of electrodes (not shown), or may be a supporting member for supporting the lead 25. In the present example, a ceramic pipe 52 is employed as the supporting member. The ceramic pipe 52 covers the lead 25 so as to inhibit the oxidation of the lead 25 and to provide electrical insulation. The ferrite permanent magnet 51 is fixed to the ceramic pipe 52. With this configuration, the ceramic pipe 52 can serve both as a member for inhibiting oxidation of the lead 25 and a member for securing the permanent magnet 51. It is noted that although not shown in FIG. 6, the ferrite permanent magnet 51 may have a cylindrical shape so that the lead 25 passes through the ferrite permanent magnet 51. By employing these configurations, the ferrite permanent magnet 51 can be securely mounted.

Figure 7:
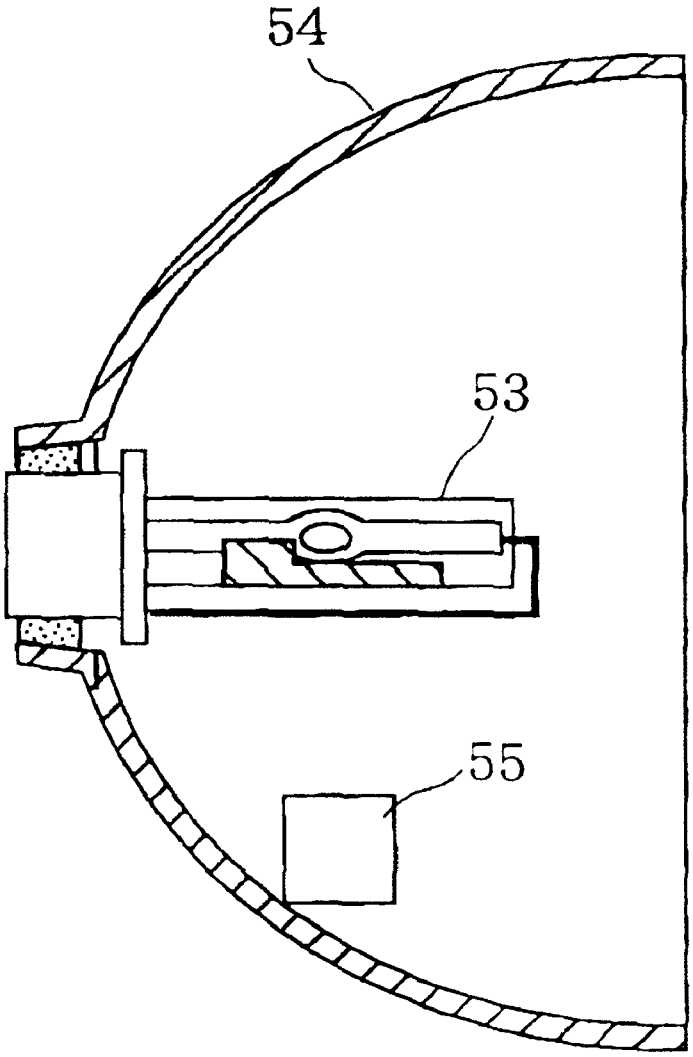
FIG. 7 is a schematic side view showing still another embodiment of the high intensity discharge lamp of Example I-2 according to the present invention.

Further, an embodiment shown in FIG. 7 is also possible. FIG. 7 shows a schematic side view of another exemplary configuration of the high intensity discharge lamp of Example I-2 according to the present invention.

In FIG. 7, the high intensity discharge lamp 53 is provided inside a reflector (optical unit) 54, and a ferrite permanent magnet 55 is attached to the reflector 54. By employing this configuration, when the replacement of the high intensity discharge lamp 53 is required due to the expiration of the lamp life, only the high intensity discharge lamp 53 can be replaced without changing the ferrite permanent magnet 55. Accordingly, this configuration has the advantageous effect of reducing the manufacturing cost.

Miscellaneous

As discussed above, a plurality of specific examples of means for generating a magnetic field and the positions where the means is to be provided are described in Example I-2. These are summarized below.

Examples of the means for generating a magnetic field include the following (i) to (iii).

(i) The magnetic field generating means may be a permanent magnet.

(ii) The magnetic field generating means may be a magnetic material film formed on a surface of the arc tube or on the outer tube to be attached outside the arc tube.

(iii) The magnetic field generating means may be a light blocking film comprising a magnetic material.

It is also understood that many variations of the magnetic field generating means for applying a magnetic field to the arc are possible other than the examples shown above, and substantially the same effects can be obtained insofar as the means is a magnetic material. In addition, in place of the magnetic material, a magnetic field may be generated by supplying electric current to a coil, and such the magnetic field generated by the coil may be employed.

The position of the means for generating a magnetic field may be as follows.

(iv) The magnetic field generating means may be disposed at a position where the light from the arc tube is blocked by a light blocking film formed on the outer tube provided outside the arc tube.

(v) The magnetic field generating means may be supported by a means for supporting, specifically, a wiring member having electrical continuity with one of the pair of the electrodes or a supporting member for supporting the wiring member.

(vi) The magnetic field generating means may be provided on a reflector (optical unit) in which the high intensity discharge lamp is incorporated.

Embodiment II

In Embodiment II, preferred embodiments of a high intensity discharge lamp having a magnetic field generating means for applying a magnetic field including a magnetic flux component perpendicular to a line connecting a pair of electrodes across the gap between a pair of electrodes provided inside the arc tube are discussed, and the lamp is configured such that alternating current is supplied between the pair or electrodes and a frequency of the alternating current is varied. Thereby, the arc bend amount can be controlled in a simple manner at low cost. Further, by varying the frequency of the alternating current with a frequency controlling means in the state where a magnetic field is applied in the same direction as that of the arc bend, an apparent arc width can be easily controlled. Specific examples thereof are discussed in the following Examples II-1, II-2, and II-3.

Example II-1

Now, with reference to the drawings, a preferred embodiment according to Embodiment II is detailed below.

Figure 8:
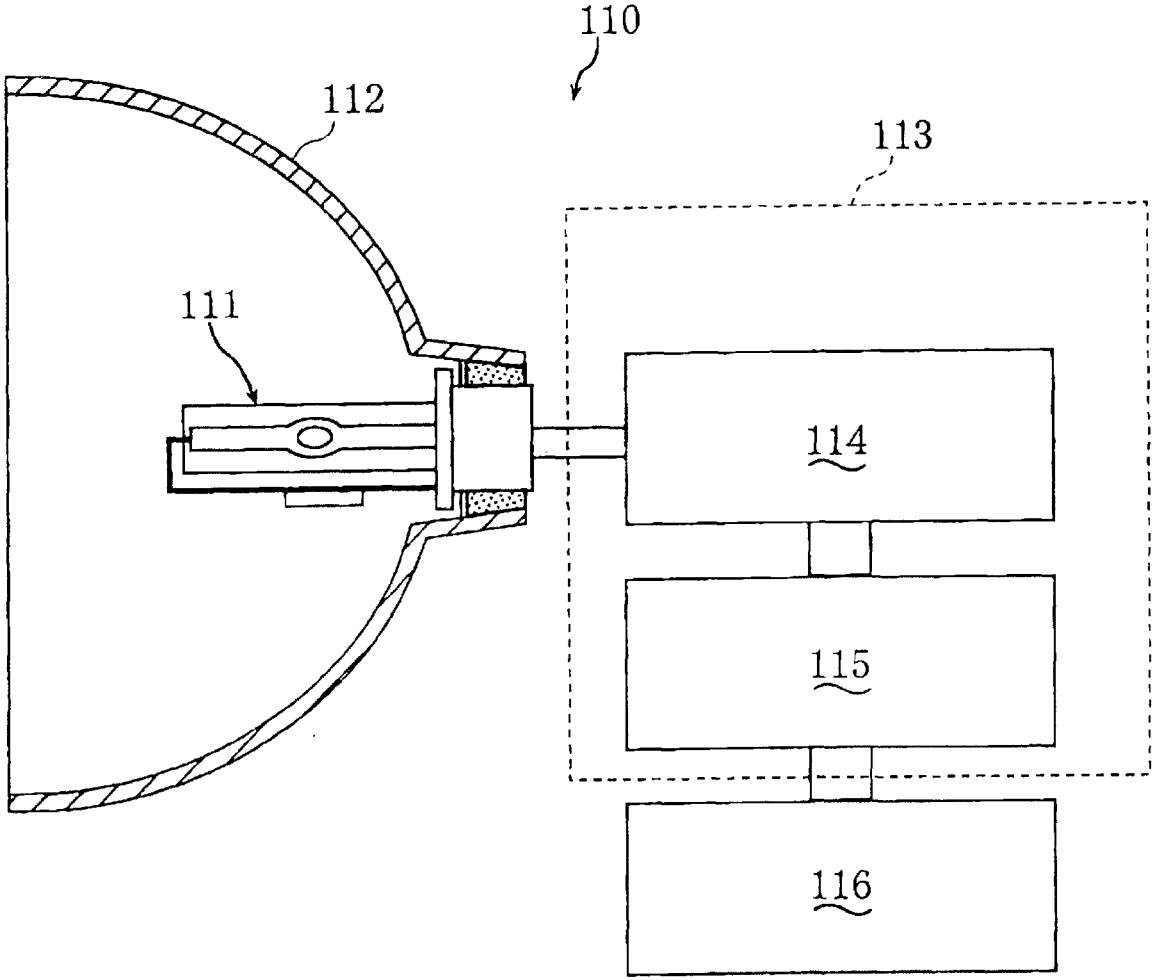
FIG. 8 is a schematic side view showing a high intensity discharge lamp system of Example II-1 according to the present invention.
Figure 9:
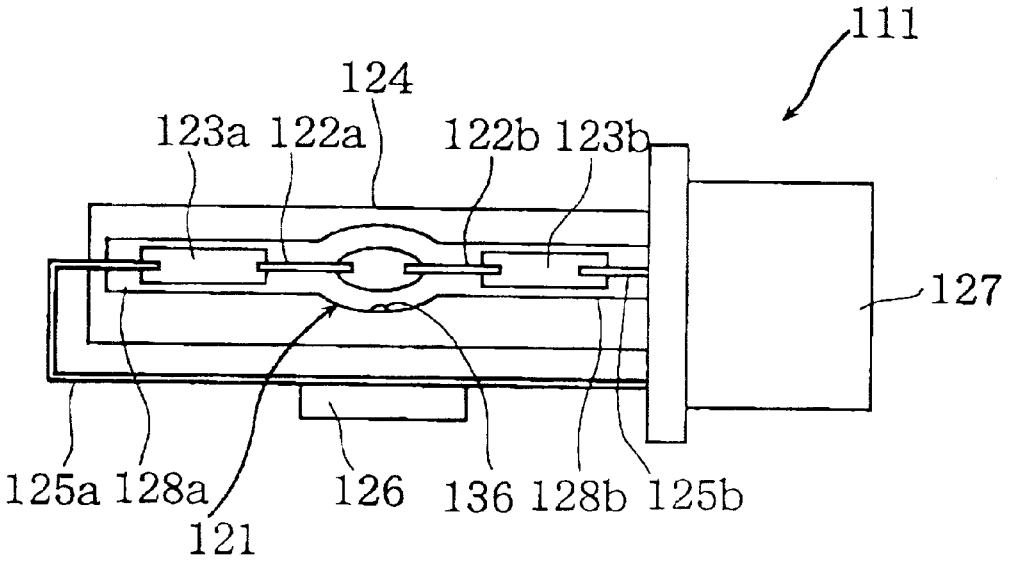
FIG. 9 is a schematic side view showing a high intensity discharge lamp constituting the high intensity discharge lamp system of Example II-1 according to the present invention.
Figure 16:
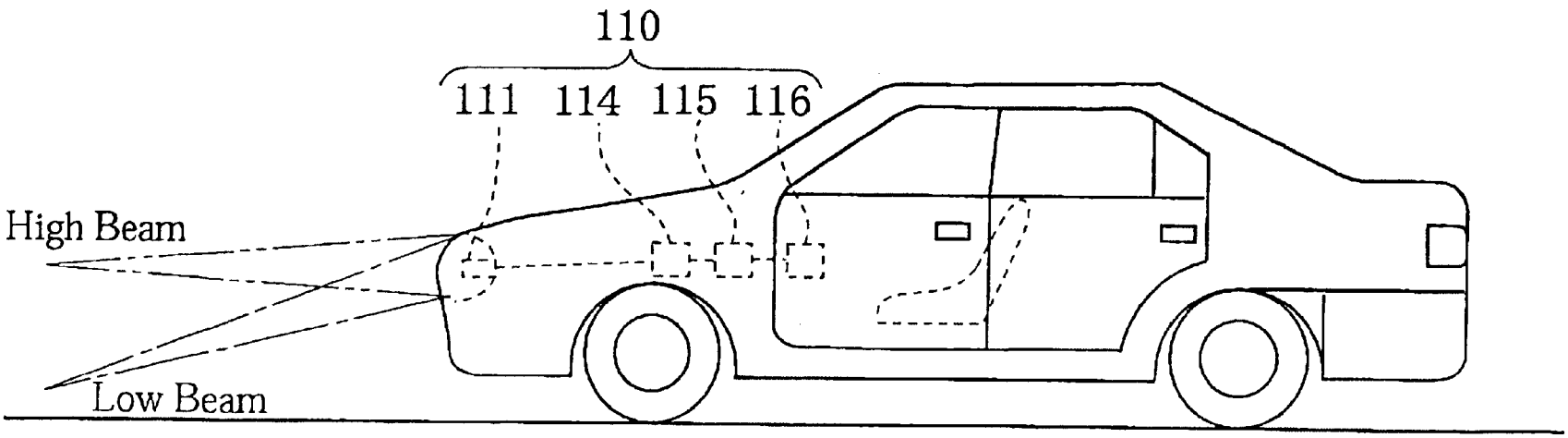
FIG. 16 is a schematic view illustrating the high intensity discharge lamp system being incorporated in an automobile.

FIG. 8 shows a schematic side view of a high intensity discharge lamp system 110 of Example II-1 according to the present invention. FIG. 9 shows a schematic cross sectional view illustrating the configuration of a high intensity discharge lamp 111 constituting the high intensity discharge lamp system 110. FIG. 16 illustrates an example in which the high intensity discharge lamp system of the present example is incorporated in an automobile.

As shown in FIG. 8, the high intensity discharge lamp system 110 of Example II-1 comprises a high intensity discharge lamp 111, a reflector 112, an operating circuit 113 and so forth.

The high intensity discharge lamp 111 is placed in the reflector 112 so that the line connecting a tip of one of the electrodes 122*a* and a tip of the other electrode 122*b* is horizontal (i.e., the lamp 111 is horizontally operated). The high intensity discharge lamp 111 is connected to the operating circuit 113 and supplied with a 0.5 A rectangular wave alternating current so as to be operated at a rated power of 35 W.

The operating circuit 113 has an inverter circuit 114 and an operating frequency controlling circuit 115. To the operating frequency controlling circuit 115, an operating frequency selecting switch 116 is connected which can select arbitrary frequencies. The inverter circuit 114 is configured so as to output an alternating current having a frequency selected by the operating frequency selecting switch 116 according to the control by the operating frequency controlling circuit 115. In order to prevent acoustic resonance resulting from the compression waves generated by the expansion and contraction of the gas inside the arc tube, it is preferable to control the lamp operation within the frequency range of several kHz or lower. It is also preferable that the waveform of the current be a rectangular wave current, which tends not to have compression waves and tends not to cause acoustic resonance.

As shown in FIG. 9, the high intensity discharge lamp 111 is, for example, configured such that, in an arc tube 121 made of quartz having an internal volume of approximately 0.025 cc, a pair of electrodes (tungsten electrodes) 122*a* and 122*b* are provided so that the distance between the electrode tips is approximately 4 mm and a filling material 136 is enclosed therein. The arc tube 121 is covered by an outer tube 124, and fixed to a cap 127. Each of the electrodes 122*a* and 122*b* is connected to the external lead (molybdenum lead) 25 via a metal foil (molybdenum foil) 123*a* or 123*b* hermetically sealed in an electrode sealing portion 128*a* or 128*b* of the arc tube 121. A ferrite permanent magnet 126 is fixed to one of the leads 125. By the ferrite permanent magnet 126, a magnetic field in which the direction of the magnetic flux is vertical is formed between the electrodes 122*a* and 122*b*. The ferrite permanent magnet 126 is not necessarily fixed to the lead 125, but is preferably securely mounted so that the magnetic field as mentioned above can be formed. The polarity of the magnetic flux (i.e., north pole or south pole) is not particularly restricted.

The flling material 136 may include, for example, indium iodide ($InI_3$) having a positive valence of 3, thallium iodide (TlI), scandium iodide ($ScI_3$), and sodium iodide (NaI). Also in the arc tube 21, xenon gas (not shown), a rage gas, is enclosed at a pressure of approximately 1.4 MPa at room temperature.

Using the high intensity discharge lamp system 110 configured as described above, the magnetic field to be applied to the arc was varied to be approximately 8 mT, approximately 5 mT, approximately 3 mT, and approximately 2 mT, and in each case, the frequency of the rectangular wave current supplied from the operating frequency controlling circuit 113 (operating frequency) and the relationship between the operating frequency and the arc bend amount between the electrodes 122*a* and 122*b* was observed. The results are shown in FIG. 10.

Figure 11:
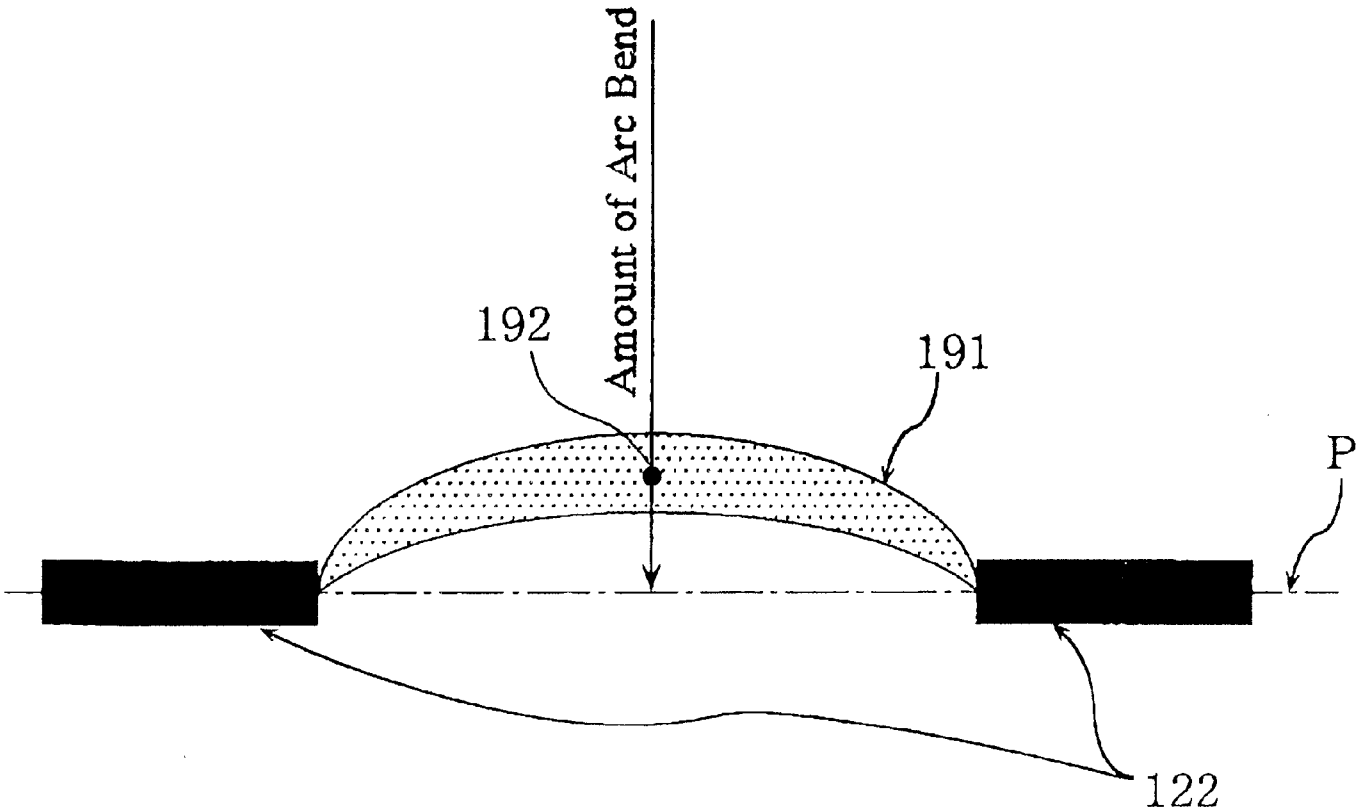
FIG. 11 illustrates the arc bend amount in the high intensity discharge lamp of Example II-1 according to the present invention.

The term "the arc bend amount" herein means, as shown in FIG. 11, a distance from the axis P of the electrodes 122*a* and 122*b* to the center 192 of the arc 191. The center 192 of the arc is defined to be a spot in the arc having the highest luminance in the central portion of the line between the electrode tips. The arc was photographed with a CCD camera (not shown), and the arc bend amount was obtained by measuring the luminance distribution.

Figure 10:
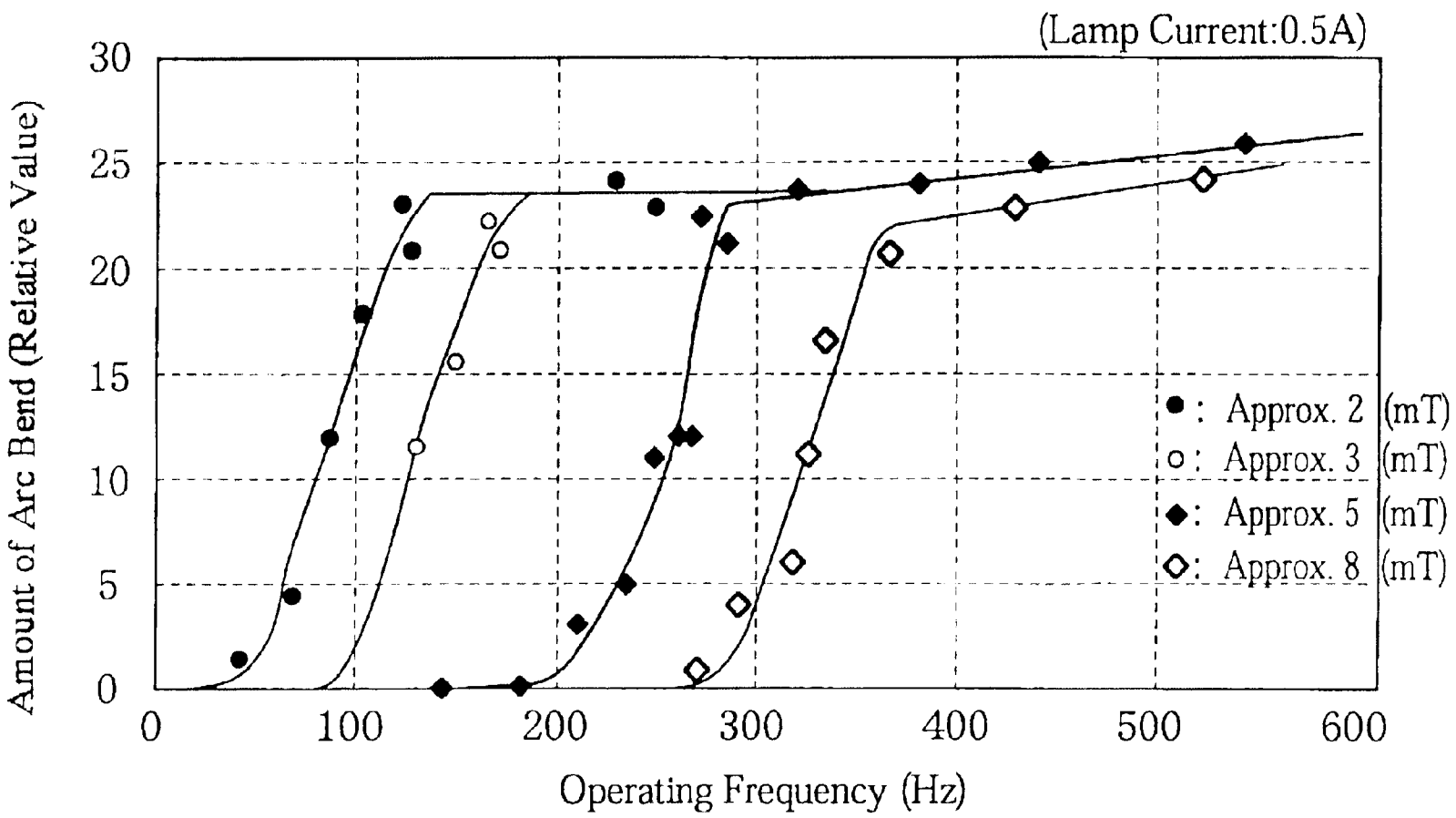
FIG. 10 is a graph showing the relationship between an operating frequency and an arc bend amount in a high intensity discharge lamp system of Example II-1 according to the present invention.

As shown in FIG. 10, for example, in the case of the magnetic field being about 8 mT, where the operating frequency is in the range of approximately 280 Hz to 360 Hz, the arc bend amount varies in a continuous manner according to the change of the operating frequency. Where the operating frequency is 280 Hz or lower, the arc bend is suppressed and the arc bend amount becomes 0 (the arc is not bent) Where the operating frequency is 360 Hz or higher, the arc bend amount becomes approximately the maximum value (the arc greatly curves, making contact with the arc tube wall) When the applied magnetic field is varied so as to be approximately 8 mT, approximately 5 mT, approximately 3 mT, and approximately 2 mT, the frequency at which the arc bend is suppressed is accordingly varied.

Therefore, when the applied magnetic field to the arc is constant, the arc bend amount between the electrodes 122*a* and 122*b*, that is, the position of the light source (arc) in the arc tube 121 can be adjusted by controlling the frequency of the rectangular wave alternating current supplied from the operating circuit 113 (operating frequency).

Figure 12A:
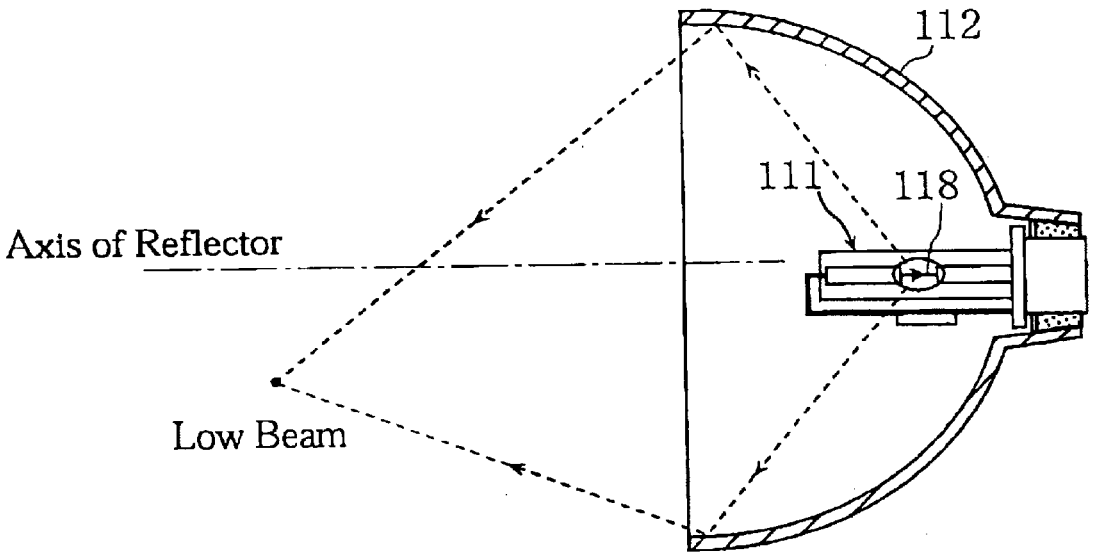
FIGS. 12(*a*) and 12(*b*) are schematic side views illustrating light distributions (low beam and high beam) of the high intensity discharge lamp system of Example II-1 according to the present invention.
Figure 12B:
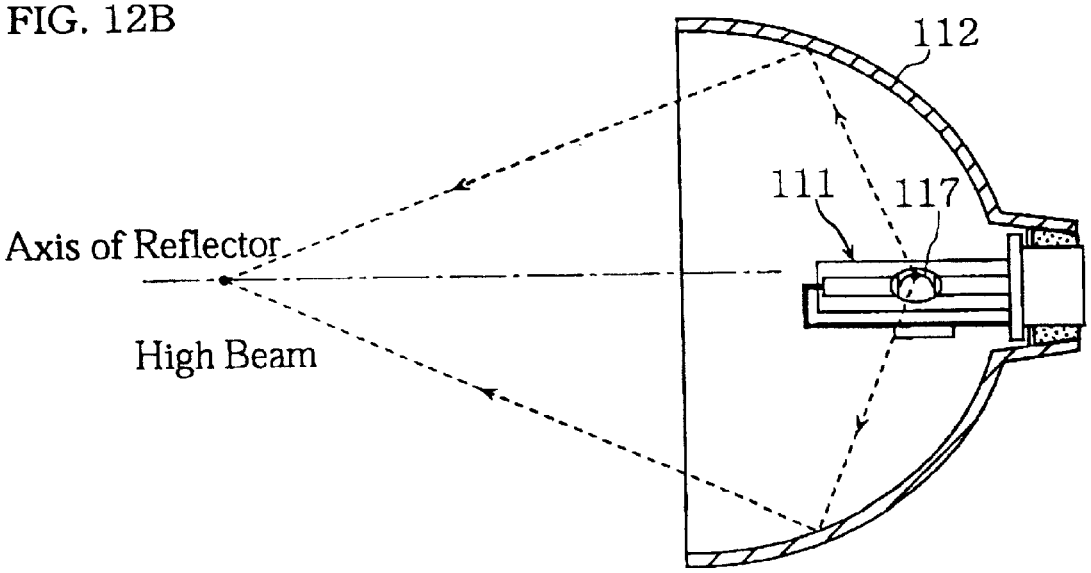

As a result, as shown FIGS. 12(*a*) and 12(*b*), by generating a bent arc 117 and a non-bent arc 118, two different focal points can be obtained. More specifically, as shown in FIG. 12(*a*), when the non-bent arc 118 is placed at a position off the focal point of the reflector 112 (off the axis of the reflector) the light emitted from the arc 118 and reflected by the reflector 112 is focused not on the axis of the reflector 112 but on a point slightly off the axis. By contrast, as shown in FIG. 12(*b*), when the bent arc 117 is placed at the focal point of the reflector 112, the reflected light from the arc 117 is focused on the axis of the reflector 112.

The phenomenon described above occurs when the arc is bent in the same direction as that of the magnetic flux, and in this respect, the system of the present invention differs from conventional systems utilizing the effect of Lorentz force, in which the magnetic flux perpendicular to the direction of the arc bend is applied. The major differences between the configurations in which the arc bend amount is controlled in the manner according the present invention and the configuration in which the arc bend amount is controlled according to conventional techniques are summarized in Table 3 below.

TABLE 3

| | The present invention | Conventional technique |
|---|---|---|
| Direction of applying magnetic field | Same as the direction of arc bend | Perpendicular to the direction of arc bend |
| Means of applying magnetic field | Permanent magnet | Electromagnet |
| Controlling of arc bend | By controlling operating frequency | By controlling electric power supplied to electromagnet |
| Frequency | Variable | Fixed |

The high intensity discharge lamp system 110 can be employed, for example, as a system for vehicle headlamp as shown in FIG. 16. Specifically, for example, the magnetic field to be applied to the high intensity discharge lamp is made 8 mT. By operating the operating frequency selecting switch 116 provided in a position near the driver's seat in the automobile, the operating frequency can be selected to be 280 Hz or 360 Hz so as to change the position of the arc between two positions. This makes it possible to provided a high intensity discharge lamp capable of attaining both high beam and low beam with only one lamp by a simple and low-cost configuration.

As already mentioned above, when the magnetic field to be applied is approximately 8 mT, the arc bend amount is varied in a continuous manner according to the change of the operating frequency. Therefore, if the lamp system is configured such that the operating frequency can be controlled in a stepwise manner or in a continuous manner in the above range with the use of the operating frequency selecting switch 116, the light axis adjustment can be realized without a complex mechanical adjusting mechanism, such as conventionally-used varying of the position of the reflector and the like. Of course, the beam modes to be selected are not limited to two modes and may be more than two modes. In addition, the light axis adjustment may be adapted to one of the plurality of beam modes or all of the beam modes.

Next, controlling of an apparent arc width is discussed below.

In Example II-1, the arc bend amount is controlled by varying the operating frequency, and Lorentz force acts on the arc rather than the force suppressing the arc bend. If the operating frequency is varied while the Lorentz force is being applied to the arc, an apparent arc width along the horizontal directions of the arc can be varied This makes it possible to vary the light distribution of a lamp by incorporating the lamp in the reflector.

Figure 14:
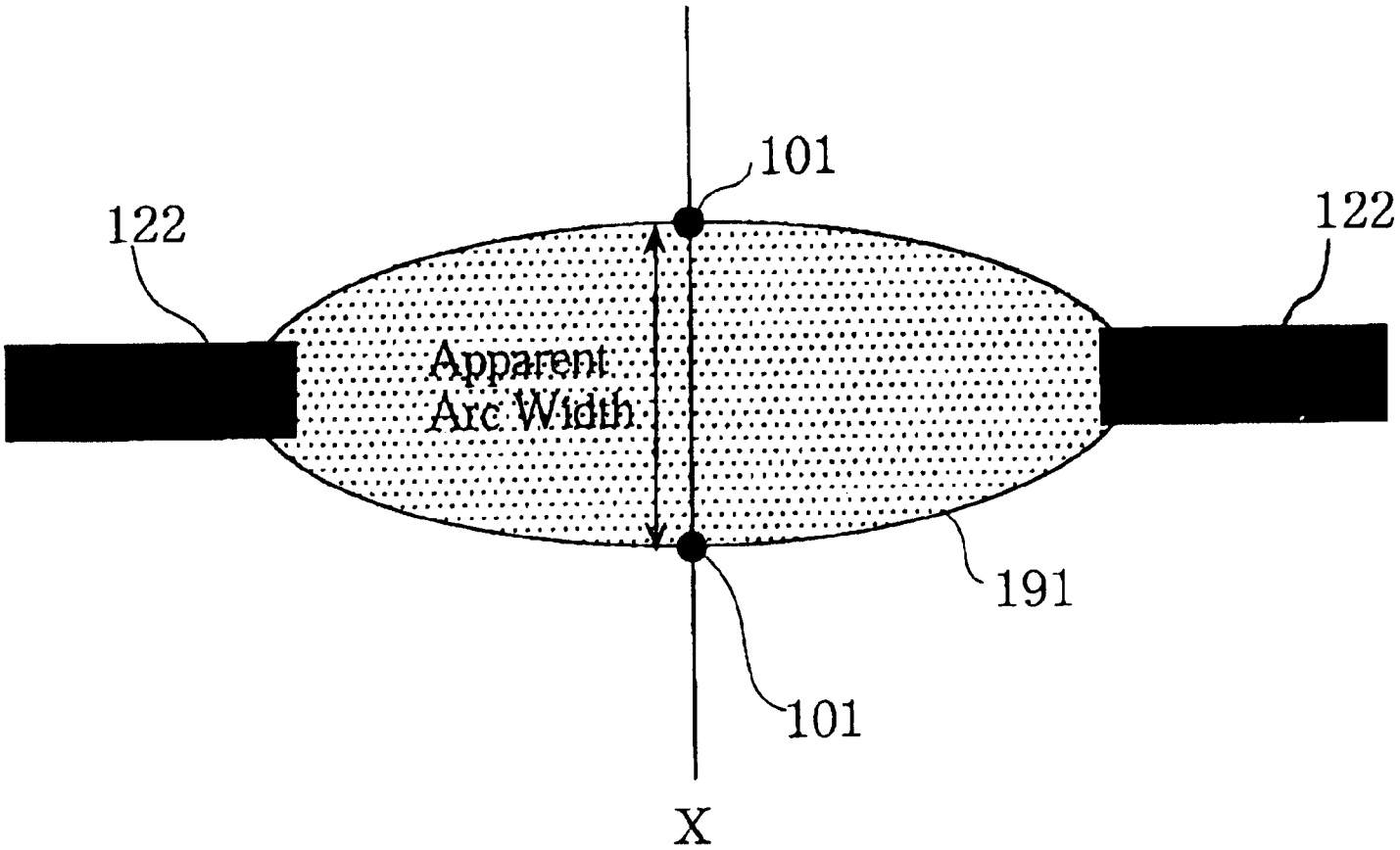
FIG. 14 illustrates an apparent arc width of the high intensity discharge lamp of Example II-1 according to the present invention.

The term "apparent arc width" herein is defined as follows. As shown in FIG. 14, a high intensity discharge lamp is horizontally operated with, for example, a rectangular wave alternating current, and, while the arc 191 is being viewed from the top, the distance between two points 101*a* and 101*b* positioned on the line X going through the center of the arc 191 and perpendicular to the line connecting the electrodes 122*a* and 122*b*, at each of which points the luminance is 20% of the maximum luminance, is obtained.

The distance thus obtained is defined to be the apparent arc width herein. To measure the apparent arc width, luminance distribution of the arc was measured by photographing the arc with the use of a CCD camera in the same manner as in the case of measuring the arc bend amount.

Figure 13:
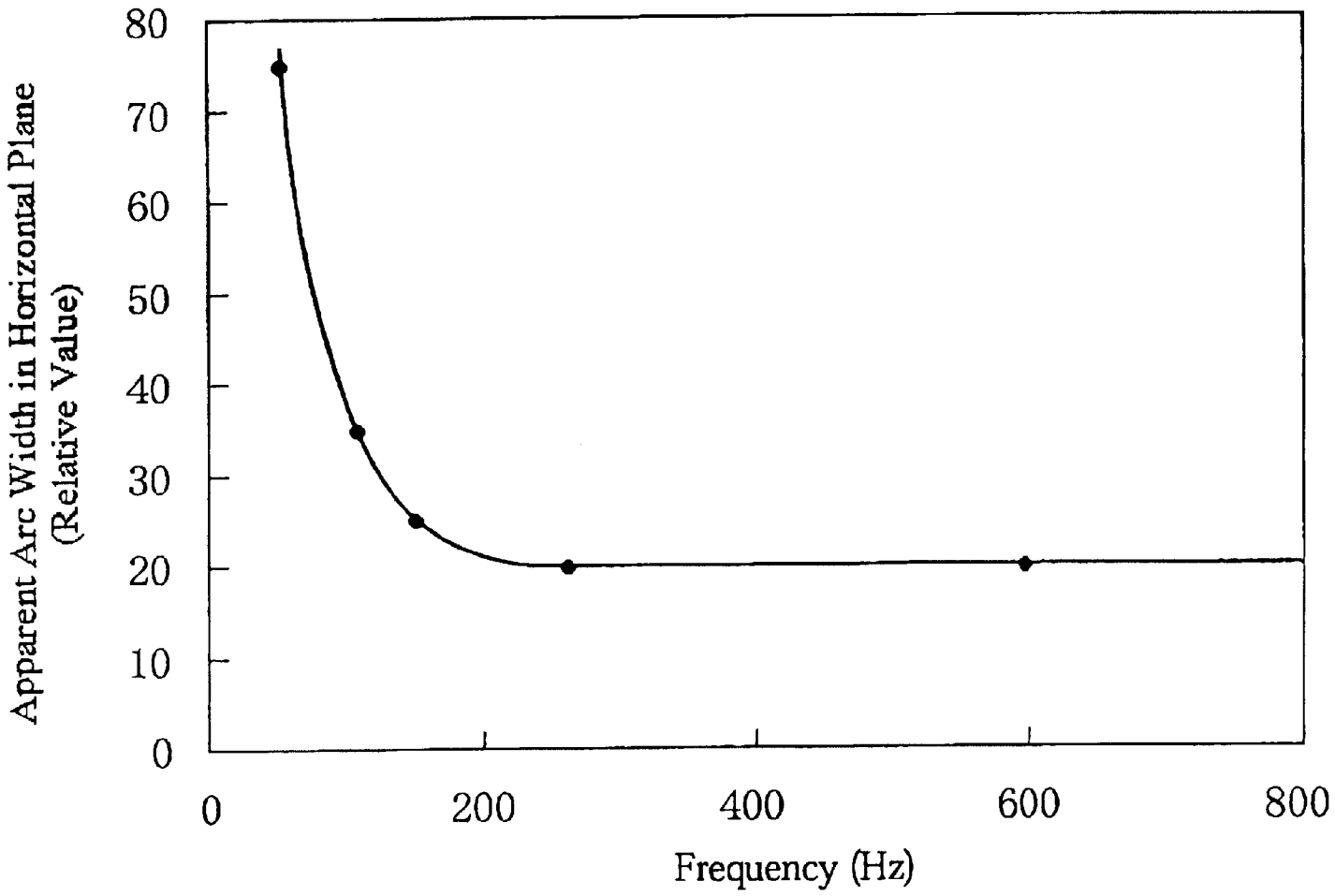
FIG. 13 is a graph illustrating the relationship between an operating frequency and an apparent arc width in the high intensity discharge lamp of Example II-1 according to the present invention.

FIG. 13 illustrates the relationship between the apparent arc width in a horizontal plane when the high intensity discharge lamp was viewed from the top and the operating frequency. The measurement was performed at a constant magnetic field intensity of approximately 8 mT (see FIG. 10) and at operating frequencies of 50 Hz, 100 Hz, 150 Hz, 260 Hz, and 600 Hz. It is noted that, referring to FIG. 10, when the operating frequency was in the range of 50–260 Hz, the arc bend was not observed, while when the operating frequency is 600 Hz, the arc was bent. As understood from FIG. 13, depending on the operating frequency, the apparent arc width in the horizontal plane varied. The variation of the apparent arc width was observed when the operating frequency was approximately 300 Hz or lower.

Figure 15A:
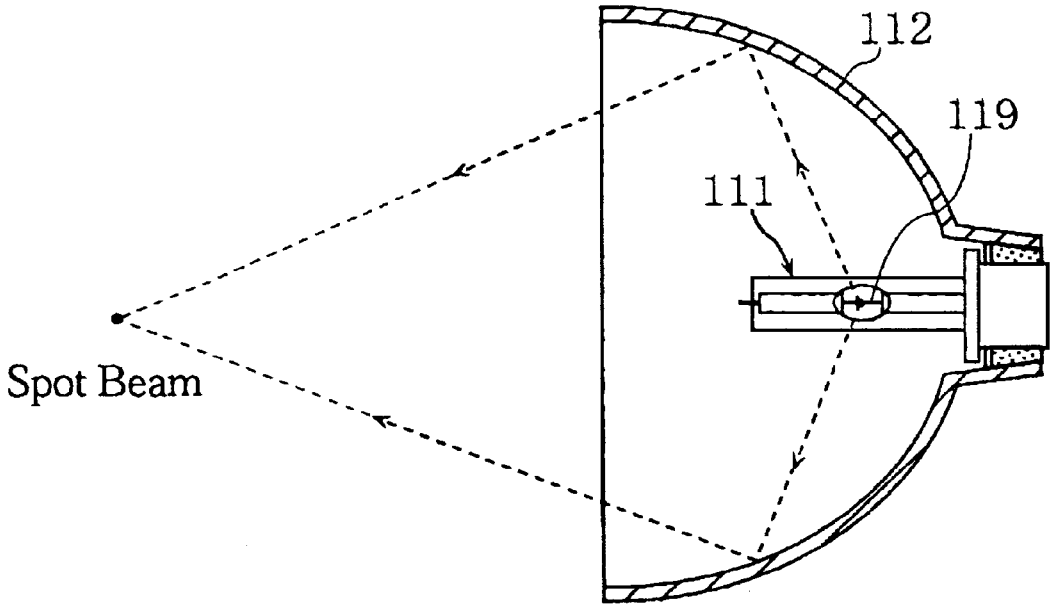
FIGS. 15(*a*) and 15(*b*) are top views illustrating the light distributions (spot beam and wide beam) of the high intensity discharge lamp system of Example II-1 according to the present invention.
Figure 15B:
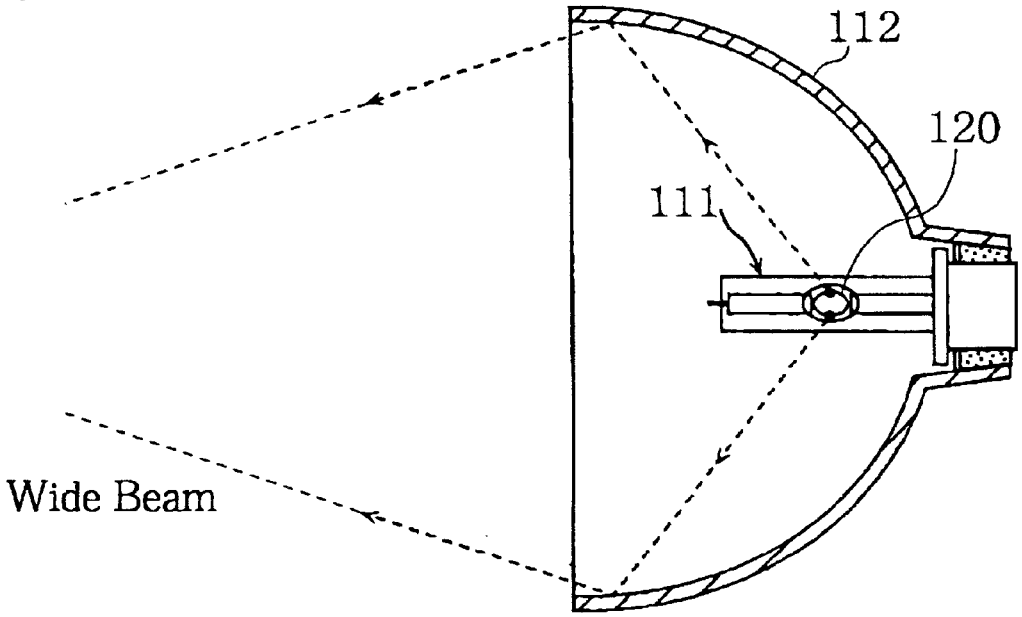

FIGS. 15(*a*) and 15(*b*) show top views illustrating the high intensity discharge lamp and the reflector. It is understood that varying an apparent arc width is equivalent to varying the size of the light source in the reflector.

In other words, as shown in FIG. 15(*a*), when the arc width is small, the size of the arc 119 (light source) is small and the light from the reflector becomes a spot beam. On the other hand, as shown in FIG. 15(*a*), when the arc width is large, the size of the arc 120 (light source) is large and the light from the reflector becomes a wide beam. That is, if the operating frequency can be selected from two frequencies, 100 Hz and 300 Hz, by manipulating the operating frequency selecting switch 116, the apparent arc width can be varied, so that such beam selecting as shown in FIGS. 15(*a*) and 15(*b*) can be attained by making the arc width large to obtain a wide beam and by making the arc width small to obtain a spot beam.

The phenomenon of such arc width variation occurs because a Lorentz force acts on the arc in a direction within a horizontal plane and perpendicular to the line connecting between the tips of the electrodes, and thereby the curve of the arc moves in the direction of the Lorentz force. In the case where the discharge lamp is operated with alternating current, at the same time as the current polarity reversal, the Lorentz force acts in the opposite direction to the foregoing direction in the horizontal plane, which causes the arc to move in the opposite direction in the horizontal plane. As a result, by the variation of the frequency, the cycle of the electric current flowing one direction changes, and the time during which the Lorentz force acts on the arc in one direction also changes. For example, when the operating frequency becomes lower, the time during which the Lorentz force acts on the arc in one direction increases and the migration distance of the arc in the horizontal plane accordingly increases, making the observer perceive that the apparent arc width in the horizontal plane has increased.

This phenomenon was observed in the frequency range of 300 Hz or lower. It is to be understood, however, that since the frequency range in which the effect is obtained varies depending on such factors as the electrode gap of the lamp and the lamp current, it is not limited to the range of 300Hz or lower.

Next, discussed below is the configuration for a vehicle head lamp system in which, utilizing the above-described phenomenon, the light distribution pattern of the vehicle headlamp can be selected from three patterns, namely, a high and spot beam, a low and spot beam, and a low and wide beam by controlling the arc bend amount and the apparent arc width.

The procedure for the designing such a configuration is shown below.

If the lamp system is designed to attain the low beam when the arc bend is absent and the high beam when the arc bend is present, the focal point of the reflector as shown in FIGS. 12(*a*) and 12(*b*) should be such that the light from the bent arc is focused at the axis of the reflector. In this case, the relationship of the beam modes and the states of the arc are as shown in Table 4 below.

TABLE 4

| Beam mode | | | | State of arc | |
|---|---|---|---|---|---|
| High beam | Low beam | Spot beam | Wide beam | Bend | Width |
| ○ | | ○ | | Large (Present) | Small |
| ○ | | | ○ | Large (Present) | Large |
| | ○ | ○ | | Small (Absent) | Small |
| | ○ | | ○ | Small (Absent) | Large |

In order to select between the spot beam and the wide beam in the case of the low beam, it is necessary that the arc width be varied while the arc bend be absent. Specifically, in the present example, since the variation in the arc width occurs in the range of approximately 300 Hz or lower as seen from FIG. 13, it is necessary that the arc bend be absent in the range of 300 Hz or lower.

As understood from FIG. 10, when the magnetic field applied to the lamp is set at 8 mT, the variation in the arc bend does not occur in the operating frequency range of 300 Hz or lower, and thus this frequency range is usable. Thus, for example, by setting the operating frequency at 80 Hz, an arc having a large arc width and no bend can be obtained, which results in a low beam with a wide beam as seen from Table 4 above. Alternatively, as understood from FIG. 10, by setting the operating frequency at 300 Hz for example, an arc having little arc bend and a small arc width can be obtained, which results in a low beam with a spot beam as seen from Table 4 above.

Alternatively, as understood from FIG. 10, by setting the operating frequency at 400 Hz for example, an arc having a small arc width and a large arc bend can be obtained, which results in a high beam with a spot beam as seen from Table 4 above.

The selecting of the operating frequency as described above can be performed with the use of the operating frequency selecting switch 116, and therefore a desired beam mode can be obtained by a simple switch operation, without providing additional lamps.

Example II-2

The present inventors have found in the course of the experiments that the following expression (proportionality relation) holds:

Expression 1

$$F \propto (B \cdot I \cdot L)/f,$$

where B is the intensity of the magnetic field, I is the lamp current, L is the electrode gap, f is the operating frequency, and F is the force for suppressing arc bend when a magnetic field is applied.

The relationship between the operating frequency and the arc bend amount discussed in the foregoing Example 2-1 varies depending on a lamp current, and it is understood that from the expression 1 above, the larger the lamp current I is, the larger the force F acting on the arc is, resulting in a small arc bend amount.

Generally, the lamp current I is made large for example at the start of the lamp where a large lamp current is required for the fast starting up of the light beam, in which the lamp current is not constant. Accordingly, in this example, there is described an example of the high intensity discharge lamp system in which, even in such a case, the arc bend amount can be suitably controlled. It is to be noted that like elements having similar functions to those in Example 2-1 are designated by like reference numerals, and will not be further elaborated on here.

Figure 17:
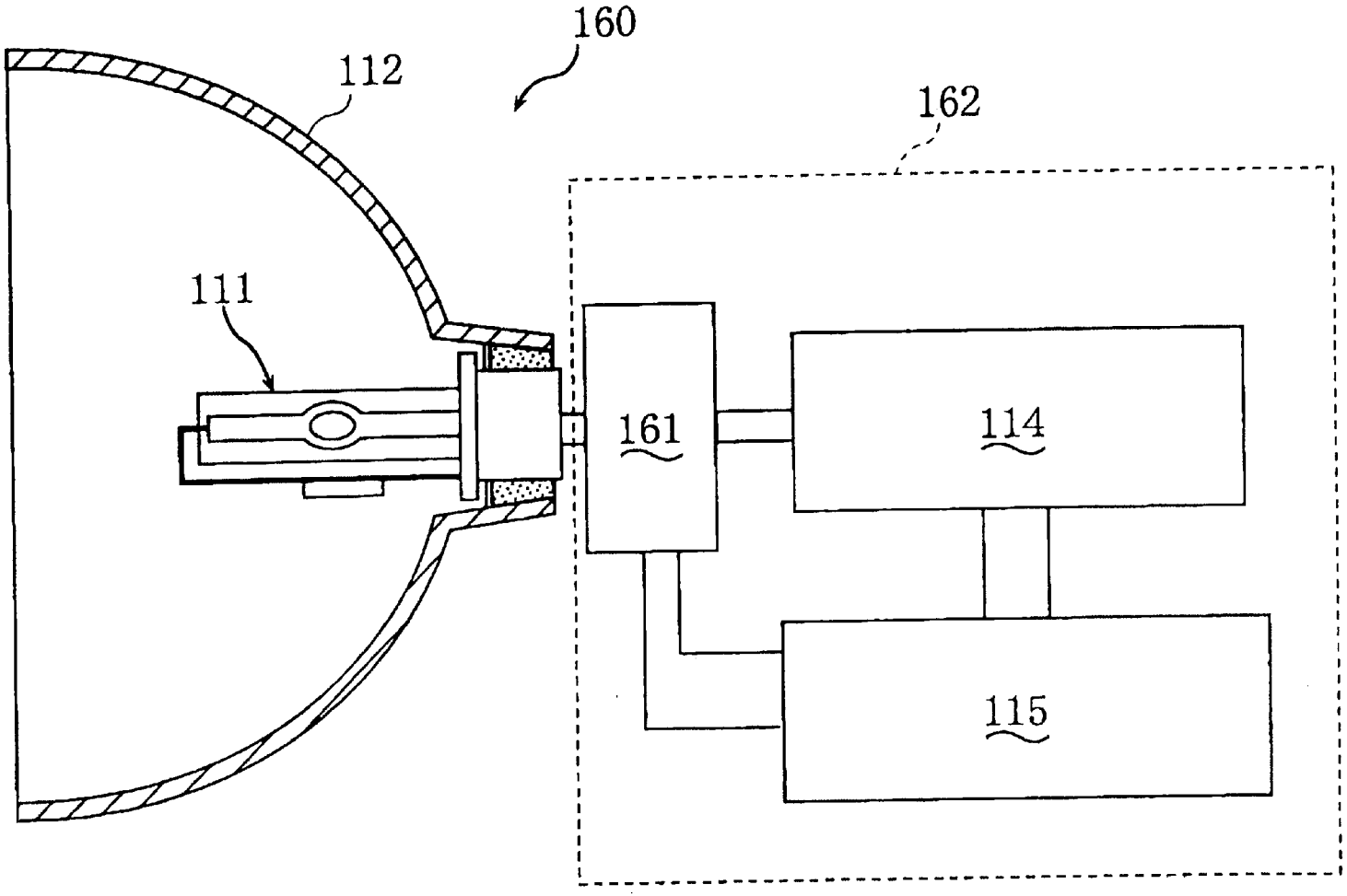
FIG. 17 schematically illustrates a configuration of a high intensity discharge lamp system of Example II-2 according to the present invention.

FIG. 17 schematically shows the configuration of a high intensity discharge lamp system 160 of Example II-2 according to the present invention. The high intensity discharge lamp system 160 has, in the operating circuit 162, a lamp current detecting circuit 161 provided between the inverter circuit 114 and the high intensity discharge lamp 111. The magnetic field to be applied to the lamp is approximately 5 mT. The operating frequency controlling circuit 115 controls the inverter circuit 114 in response to the lamp current detected by the lamp current detecting circuit 161, for example, such that when the lamp current is 0.6 A or higher the operating frequency becomes 500 Hz, while when the lamp current is less than 0.6 A, the operating frequency becomes 150 Hz. The inverter circuit 114 is configured such that the inverter circuit 114 supplies a larger current at the starting of the lamp than the rated current as shown in FIG. 18, by being controlled by a lamp current controlling circuit (not shown).

By employing such a configuration, at the starting of the lamp, a large lamp current is applied and thereby the light beam can start up quickly, and even so, since the operating frequency is made higher than that when the lamp is in the stable operation (the lamp is operated at the rated current), substantially the same arc bend amount is maintained, that is, the position of the arc is stably controlled.

Figure 18:
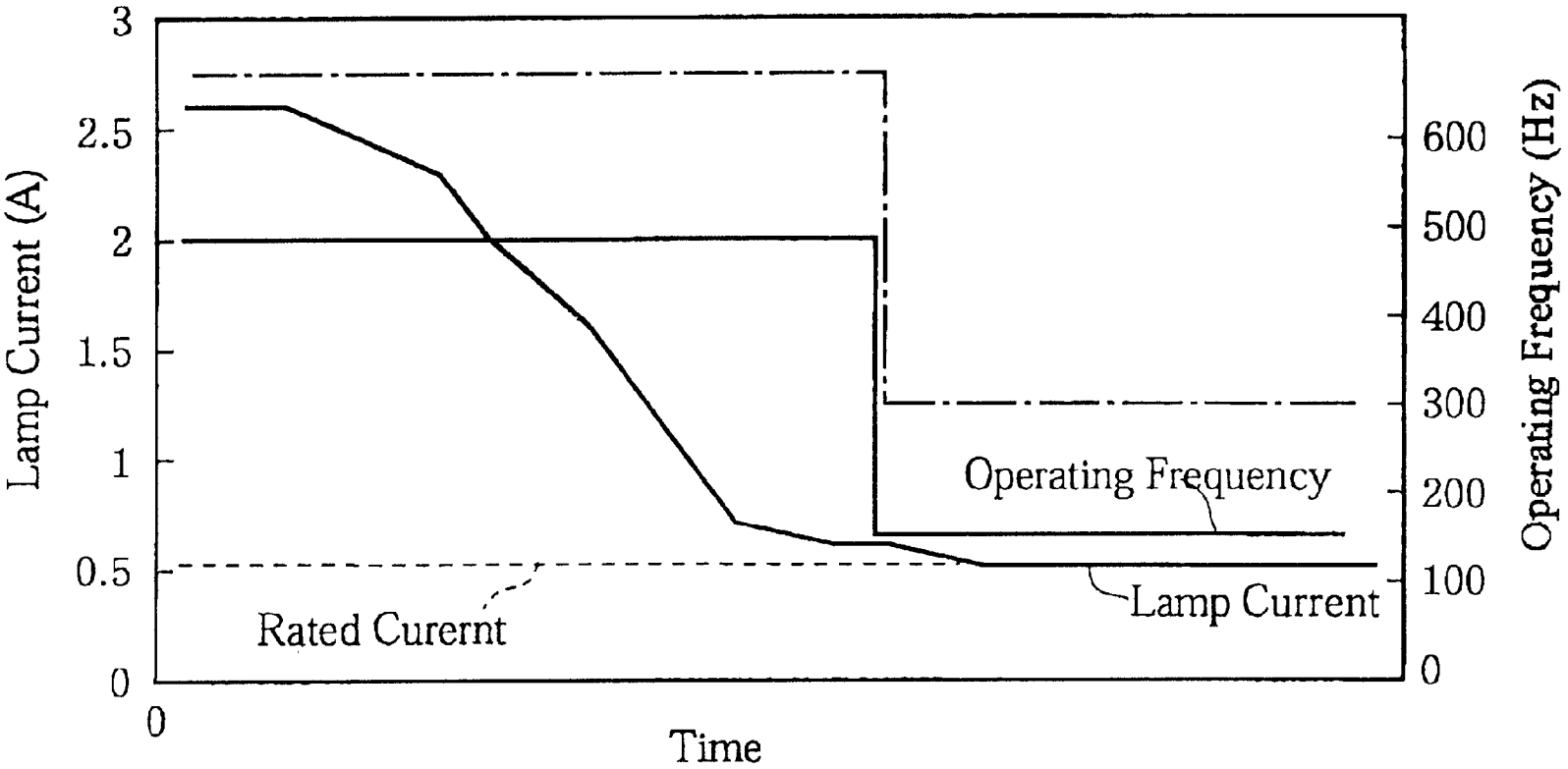
FIG. 18 is a graph illustrating the variations of a lamp current and a operating frequency with time in the high intensity discharge lamp system of Example II-2 according to the present invention.

In addition, in the case where the system is used for a vehicle headlamp and the selecting between high beam and low beam is required, when the lamp current is larger than the rated current as represented by the dashed line in FIG. 18, the operating frequency may be controlled at a frequency higher than the above-mentioned 500 Hz (designated by the alternate long and short dash line in FIG. 18). Further, at a time when the lamp current is large or immediately after the lamp has been started, the selecting of operating frequencies may be temporarily inhibited.

The controlling of operating frequencies according to lamp currents is not limited to such two stage selecting as described above, and may be configured such that the operating frequency can be controlled to vary at multiple frequencies or vary in a continuous manner, so that the arc bend amount is more stably maintained.

Figure 19:
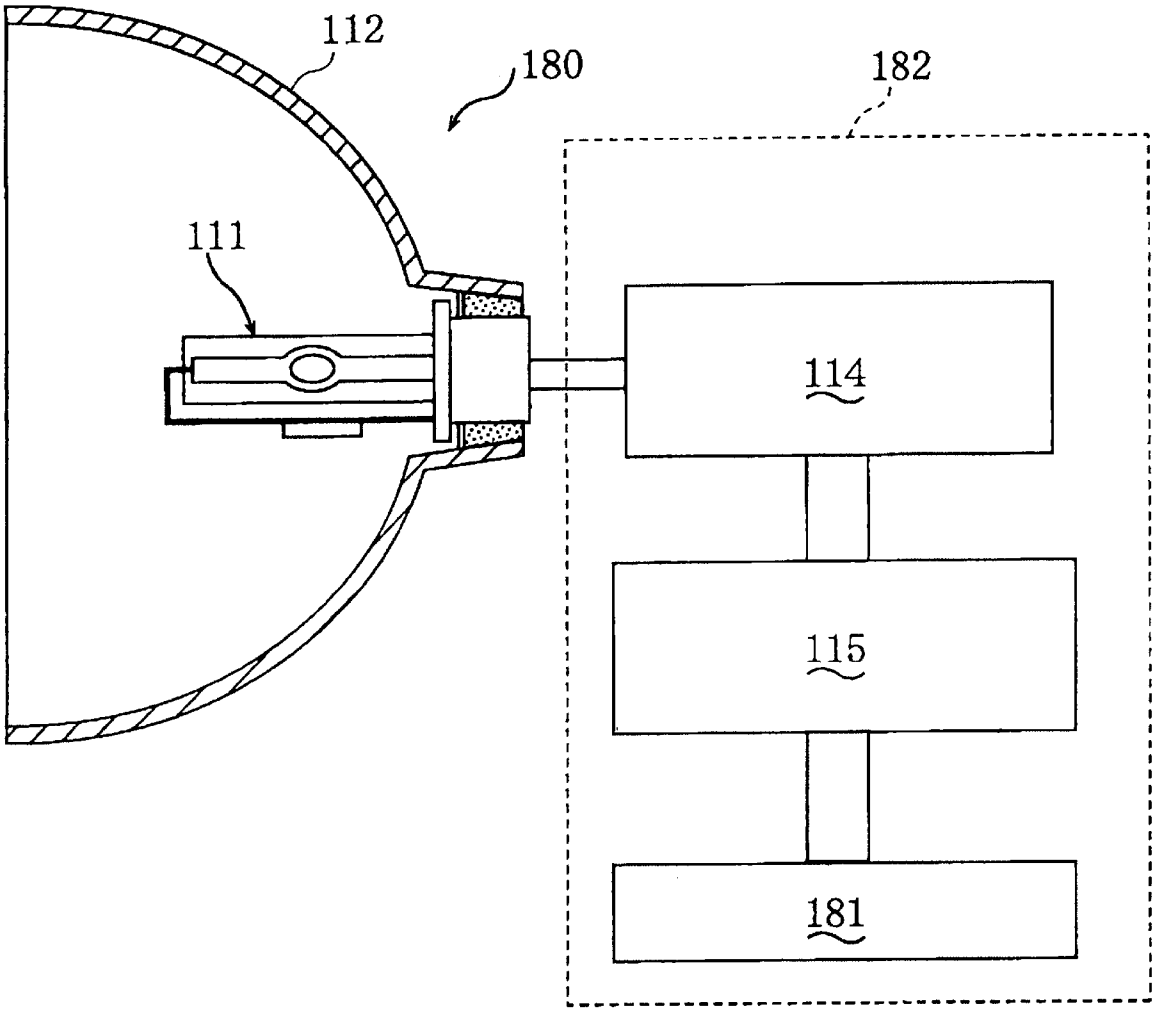
FIG. 19 is a schematic view illustrating another embodiment of the high intensity discharge lamp system of Example II-2 according to the present invention.

In addition, when the lamp current supplied from the inverter circuit 114 is controlled so as to be increased at only a predetermined time such as the starting of the lamp, instead of controlling the operating frequency by detecting the lamp current by the lamp current detecting circuit 161, it is possible to configure a high intensity discharge lamp system 180 as shown in FIG. 19 such that by providing a timer circuit 181 the operating frequency is increased (for example at 500 Hz) only during the predetermined time while the operating frequency is set at an operating frequency of the rated current (for example at 150 Hz) after the predetermined time has elapsed.

In addition, in place of directly detecting the lamp current, the operating frequency may be controlled in response to, for example, a signal for controlling the lamp current in the inverter circuit 114.

Example II-3

When a magnetic field is applied to a high intensity discharge lamp, there are cases in which flickering, variation of the light output, occurs. This flickering tends to occur especially when the lamp current is large, for example, at the starting of the lamp. According to Expression 1 discussed in the foregoing Example II-2, if a larger force F is applied to the arc than a force F at which the arc bend is suppressed by the effect of the magnetic field (at which a straight arc is obtained), the condition of the arc becomes unstable, thereby producing flicker.

The configuration shown in Example II-2 is also effective to suppress such flickering. Specifically, even in the case of a large lamp current, flicking does occur easily if the operating frequency is high. Therefore, in the case where the controlling of the arc bend amount is not essentially required, if the operating frequency is made high when the lamp current is large, the flickering can be suppressed. Furthermore, if the lamp current, the operating frequency, and the intensity of the magnetic field are optimized, not only can the arc bend amount be controlled at a desired size but also the flickering can be suppressed.

Figure 20:
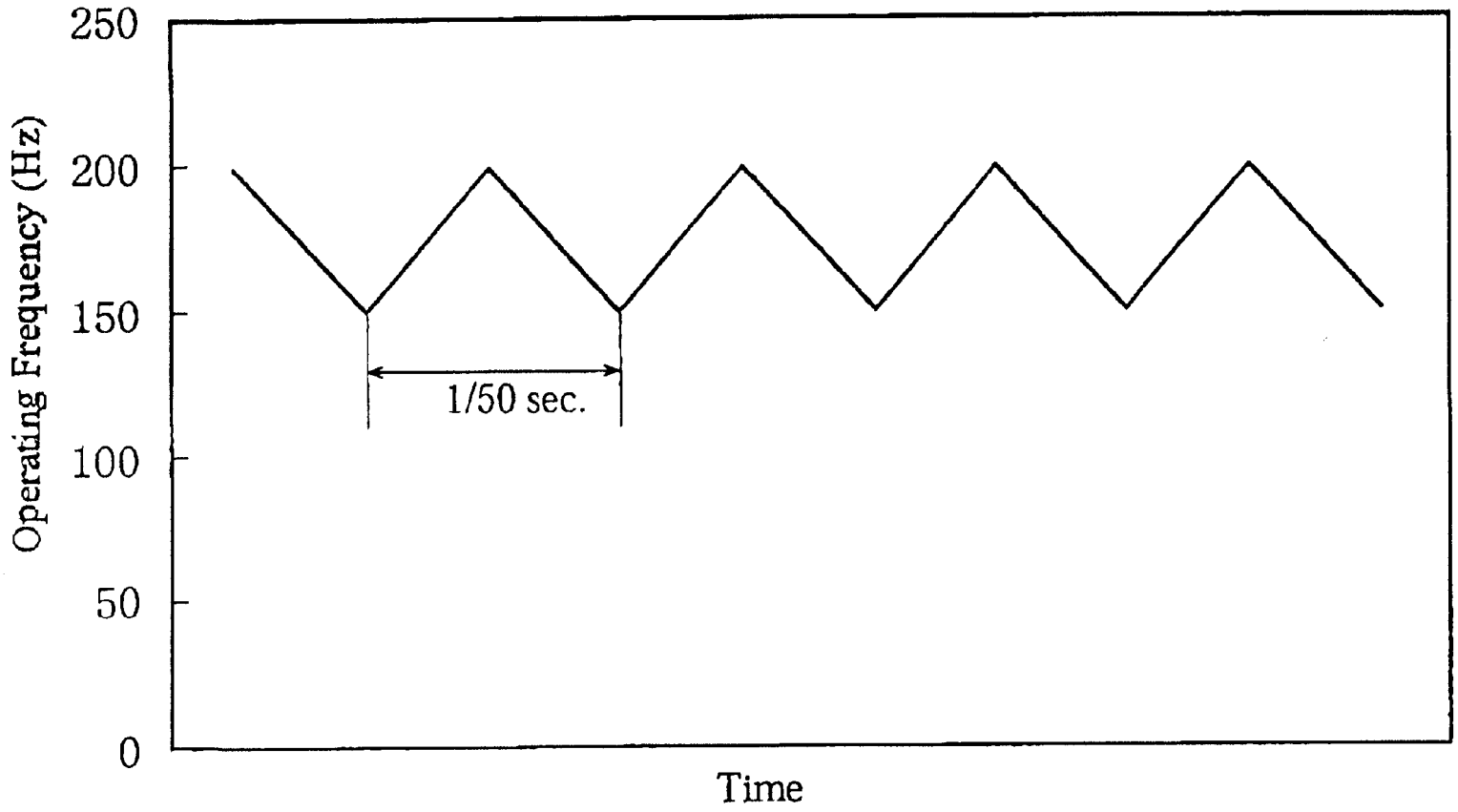
FIG. 20 is a graph illustrating a variation of the operating frequency of the operating circuit with time in a high intensity discharge lamp system of Example II-3 according to the present invention.

The suppressing of the flickering is also possible by varying the operating frequency. Specifically, as shown in FIG. 20, if the operating frequency is varied to have a saw-teeth shaped waveform with a relatively short cycle, flickering does not occur easily. Such variation of the operating frequency can be easily attained by frequency modulation (FM) of the operating frequency or the like. Such a technique of varying the operating frequency is particularly effective in the case where the operating frequency (average frequency) is lowered and the arc bend is made absent or the arc bend amount is suppressed to be small, in which case flickering is likely to occur. However, even in the case where the operating frequency is made high and the arc bend amount is made large, by varying the operating frequency, for example, between 300 Hz and 350 Hz, the suppressing of the occurrence of the flicker can be assured. The same effect can be obtained even when the variation range of the operating frequency (modulation range in the case of FM) and the variation pattern (modulation signal waveform in the case of FM) are not such as described above.

Figure 21:
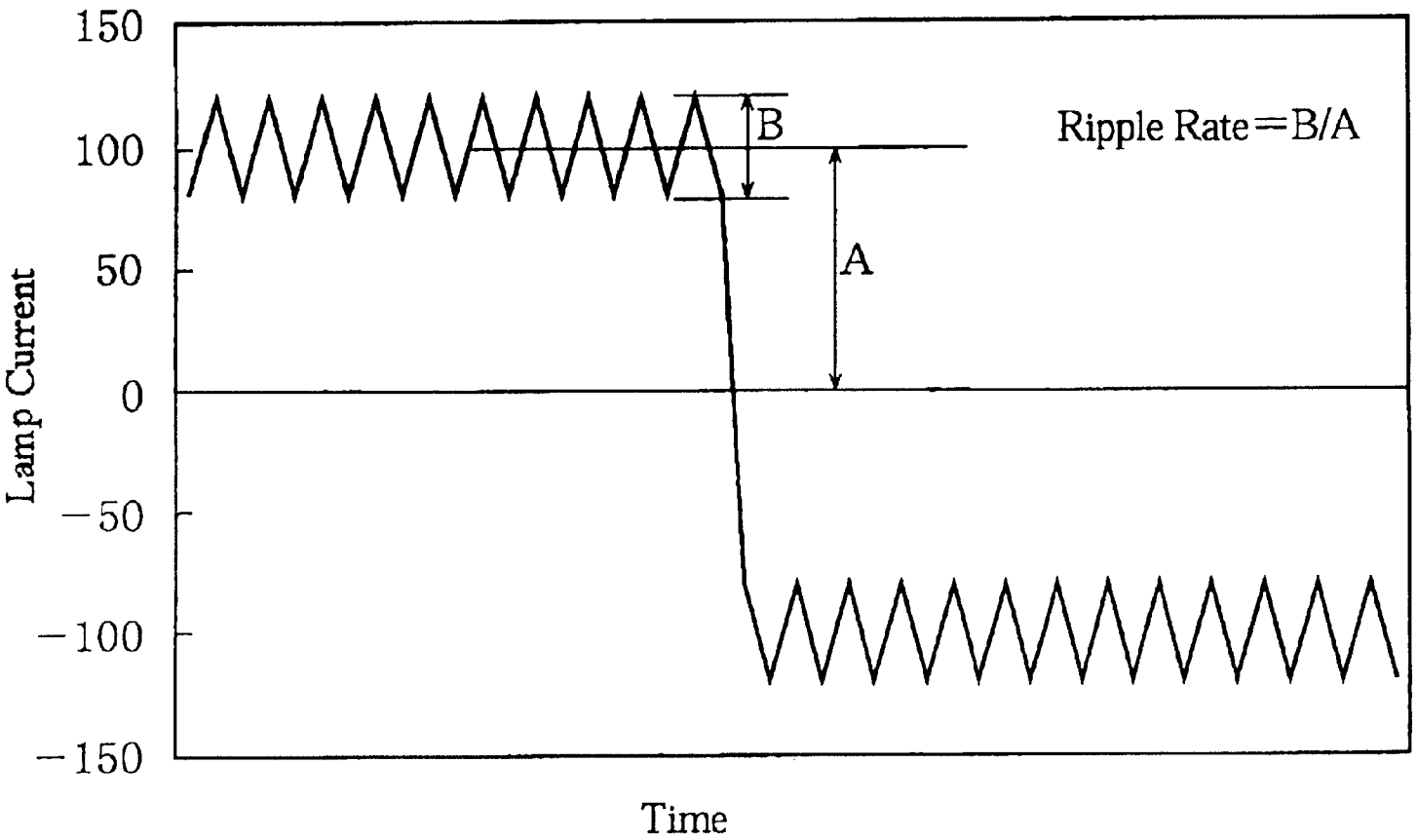
FIG. 21 is a graph showing the waveform of lamp current in a high intensity discharge lamp according to Example II-3.

In addition, the following configuration is also possible to suppress flickering. Specifically, as shown in FIG. 21, by containing a ripple in the lamp current and setting a ripple rate (B/A in FIG. 21) to be approximately 10% for example, the flicker can be suppressed. Generally, a rectangular waveform is widely used for the lamp current waveform, but the invention is not limited thereto, and the same effect can be attained with a sine wave or the like.

Each of the techniques for suppressing flickering described above can be combined together. Further, the suppressing of flickering may be carried out either only at the starting of the lamp or when the lamp current is large or at all times during the operation. Further, the suppressing of flickering may be carried out only at the time when the flickering occurs, by detecting the variation of the lamp current, the variation of the emitted light intensity, or the like.

Miscellaneous

The operating frequencies, lamp currents, variations, intensities of magnetic field, and so forth mentioned in the examples given above are illustrative only, and not to be construed as limiting the invention. The effect of controlling the arc bend amount or suppressing the flicker can be attained with various settings.

In the above examples, a ferrite permanent magnet is employed as the permanent magnet, but other types of permanent magnets and electromagnets may be employed. When an electromagnet is employed, the configurations of the invention may be combined with, for example, controlling of a size of the magnetic field or a direction of the magnetic flux.

In addition, the filling material 136 of the high intensity discharge lamp 111 is not limited to the one described above. For example, if mercury is contained in the filling material 136, the effect of controlling the arc bend amount can be attained although the degree of the controlling will be different. Further, it is preferable that the filling material contain a halide of In (Indium) since it produces a higher lamp voltage, thereby facilitating the size reduction of the operating circuit.

Further, if the high intensity discharge lamp is horizontally operated as described above, it is easy to control the arc bend amount stably and securely since the arc tends to be easily bent upwards. However, when the lamp is not horizontally operated but, for example, vertically operated, the controlling of the arc bend amount is possible by the same effect.

Further, as described above, since the arc bend amount varies also depending on the lamp current, it is also possible to control the arc bend amount by varying the lamp current.

Further, since the magnetic fields as disclosed in the above examples vary depending on the lamp conditions, the values are not limited to those shown above. Examples of the lamp conditions are: lamp currents, gas pressures enclosed in the lamp, types and amounts of metal halides enclosed in the lamp, electrode gaps, lamp powers, and so forth.

The above examples mainly discussed the cases where the lamp systems are employed for vehicle headlamps, but it is to be understood that the present invention is not limited to the fields mentioned in the above examples. For example, the present invention is effective in many fields such as searchlights and headlights for trains, in which the lamp is combined with a reflector and thus the light distribution characteristics change.

Further, the variations of the light distribution resulting from the relationship of the focal point of the reflector and the position of the lamp as described in the above examples are illustrative only, and may be altered in various manners by changing the design of the reflector.

What is claimed is:

1. A mercury-free high intensity discharge lamp comprising:

an arc tube;

a pair of electrodes located in the arc tube opposed to each other; and means for generating a magnetic field having a magnetic flux component along a direction perpendicular to a line connecting a tip of one of the electrodes to a tip of the other electrode, wherein a metal halide is enclosed in the arc tube, and a vapor pressure of the metal halide at a temperature of 900° C. is 0.1 MPa or higher.

2. The high intensity discharge lamp according to claim 1, further comprising:

means for generating alternating current to be applied across the pair of electrodes, said alternating current for operating the lamp.

3. The high intensity discharge lamp according to claim 1, wherein the the means for generating a magnetic field is for applying a magnetic field in a vertical direction when the line connecting the tips of the electrodes is horizontal.

4. The high intensity discharge lamp according to claim 1, wherein the means for generating a magnetic field is a permanent magnet.

5. The high intensity discharge lamp according to claim 1, wherein the metal halide comprises indium halide.

6. The high intensity discharge lamp according to claim 1, wherein the means for generating a magnetic field comprises a film comprising a magnetic material located either on a surface of the arc tube or on an outer tube provided outside the arc tube.

7. The high intensity discharge lamp according to claim 1, wherein the means for generating a magnetic field is supported by a supporting means.

8. The high intensity discharge lamp according to claim 7, wherein the supporting means comprises a wiring member having electrical continuity with one of the electrodes or a supporting member supporting the wiring member.

9. A driving apparatus for driving a high intensity discharge lamp comprising an arc tube, a pair of electrodes opposed to each other, means for generating a magnetic field comprising a magnetic flux component along a direction perpendicular to a line connecting a tip of one of the electrodes to a tip of the other electrode, said driving apparatus comprising: means for generating alternating current to be applied across the pair of electrodes; and a frequency controlling means for controlling the means for generating alternating current to vary a frequency of the alternating current.

10. The driving apparatus for driving a high intensity discharge lamp according to claim 9, wherein the frequency controlling means is for controlling the means for generating alternating current to vary the frequency of the alternating current with a predetermined cycle.

11. The driving apparatus for driving a high intensity discharge lamp according to claim 10, wherein the means for generating alternating current is for varying the frequency by frequency modulation, the means for generating alternating current being controlled by the frequency controlling means.

12. The driving apparatus for driving a high intensity discharge lamp according to claim 9, wherein the frequency controlling means is for controlling the means for generating alternating current to vary the frequency of the alternating current according to a lamp current.

13. The driving apparatus for driving a high intensity discharge lamp according to claim 12, further comprising:

means for detecting a lamp current; and wherein the frequency controlling means is for controlling the means for generating alternating current so that, in response to an output from the means for detecting a lamp current, the frequency of the alternating current is varied according to a lamp current.

14. The driving apparatus for driving a high intensity discharge lamp according to claim 12, wherein:

the means for generating alternating current is for generating a larger current at the start of the high intensity discharge lamp than during a stable operation of the high intensity discharge lamp;

the driving apparatus a timer for detecting a time at which a predetermined time from a starting of the high intensity discharge lamp has elapsed; and the frequency controlling means is for controlling the means for generating alternating current so that the frequency of the alternating current from the start of the high intensity discharge lamp until the predetermined time has elapsed is higher than that during the stable operation of the high intensity discharge lamp.

15. The driving apparatus for driving a high intensity discharge lamp according to claim 9, wherein the means for generating alternating current is for generating an alternating current containing a ripple having a ripple rate of 10% or more.

16. The driving apparatus for driving a high intensity discharge lamp according to claim 9, wherein the frequency controlling means is for changing the frequency of the alternating current supplied from the means for generating alternating current so that at least one of an arc bend amount and an apparent arc width is controlled.

17. A high intensity discharge lamp system comprising:

a high intensity discharge lamp comprising an arc tube, a pair of electrodes opposed to each other, means for generating a magnetic field comprising a magnetic flux component along a direction perpendicular to a line connecting a tip of one of the electrodes to a tip of the other electrode; and the driving apparatus for driving a high intensity discharge lamp, according to claim 9.

18. The high intensity discharge lamp system according to claim 17, wherein the means for generating a magnetic field comprises a permanent magnet.

19. The high intensity discharge lamp system according to claim 17, wherein the high intensity discharge lamp is operated such that the magnetic flux component is vertical.

20. The high intensity discharge lamp system according to claim 17, wherein the high intensity discharge lamp is a mercury-free discharge lamp comprising in the arc tube at least a rare gas and a metal halide.

21. The high intensity discharge lamp system according to claim 20, whrein the metal halide comprises indium halide.

22. The high intensity discharge lamp system according to claim 17, further comprising:

a reflector for reflecting a light emitted from the high intensity discharge lamp, wherein the frequency controlling means is for varying a light distribution characteristic of the light reflected from the reflector by adjusting the frequency of the alternating current.

23. The high intensity discharge lamp system according to claim 22, wherein the frequency controlling means is for adjusting a direction of an optical axis of the light reflected from the reflector by changing the frequency of the alternating current.

24. The high intensity discharge lamp system according to claim 22, wherein the frequency controlling means is for adjusting a direction of an optical axis of the light reflected from the reflector by changing the frequency of the alternating current so that the direction of the optical axis of the reflected light is directed in at least two directions.

25. The high intensity discharge lamp according to claim 1, wherein the metal halide is at least one selected from the group consisting of $HfBr_4$, $HfI_4$, $ZrI_4$, $TeI_4$, $GaBr_3$, $TiBr_4$, $TiI_4$, $SbBr_3$, $SbI_3$, $AlBr_3$, $AlI_3$, $AsI_3$, InI, $InI_3$, InBr, $BrI_3$, $SnCl_2$, $SnBr_2$, $SnI_4$, $SnI_2$, $NiI_2$, $MgI_2$, $ZnI_2$, TlCl, TlBr, TlI, $PbBr_2$, PbI, and $FeI_2$.

26. The high intensity discharge lamp according to claim 20, wherein the metal halide is at least one selected from the group consisting of $HfBr_4$, $HfI_4$, $ZrI_4$, $TeI_4$, $GaBr_3GaI_3$, $TiBr_4$, $TiI_4$, $SbBr_3$, $SbI_3$, $AlBr_3$, $AlI_3$, $AsI_3$, InI, $InI_3$, InBr, $BrI_3$, $SnCl_2$, $SnBr_2$, $SnI_4$, $SnI_2$, $NiI_2$, $MgI_2$, $ZnI_2$, TlCl, TlBr, TlI, $PbBr_2$, $PbI_2$, and $FeI_2$.

* * * * *

UNITED STATES PATENT AND TRADEMARK OFFICE

CERTIFICATE OF CORRECTION

PATENT NO. : 6,479,950 B2
DATED : November 12, 2002
INVENTOR(S) : Kiyoshi Takahashi et al.

It is certified that error appears in the above-identified patent and that said Letters Patent is hereby corrected as shown below:

Title page,
Item [30], Foreign Application Priority Data,
change "11-364628" to -- H 11-364628 --.

Column 24,
Line 7, delete "the" (second occurrence).

Column 25,
Line 1, after "apparatus" insert -- comprises --.

Column 26,
Line 33, change "$GaBr_3GaI_3$" to -- "$GaBr_3$,$GaI_3$" --.

Signed and Sealed this

Third Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,479,950 B2 
DATED : November 12, 2002
INVENTOR(S) : Kiyoshi Takahashi et al.

It is certified that error appears in the above-identified patent and that said Letters Patent is hereby corrected as shown below:

Title page,
Item [75], change "Sorkugun" to -- Sorakugun --.

Column 26,
Line 27, after "$GaBr_3$" insert -- $GaI_3$ --;
Line 29, change "PbI" to -- $PbI_2$ --.

Signed and Sealed this

Eighteenth Day of November, 2003

JAMES E. ROGAN
*Director of the United States Patent and Trademark Office*